US012357038B2

(12) United States Patent
Armstrong

(10) Patent No.: US 12,357,038 B2
(45) Date of Patent: Jul. 15, 2025

(54) FEATURES FOR OUTDOOR AND STORM-PROTECTION CLOTHING

(71) Applicant: FIRST LITE, LLC, Hailey, ID (US)

(72) Inventor: Galen L. S. Armstrong, Nelson (CA)

( * ) Notice: Subject to any disclaimer, the term of this patent is extended or adjusted under 35 U.S.C. 154(b) by 0 days.

(21) Appl. No.: 18/385,330

(22) Filed: Oct. 30, 2023

(65) Prior Publication Data

US 2024/0138495 A1 May 2, 2024

Related U.S. Application Data

(60) Provisional application No. 63/420,149, filed on Oct. 28, 2022.

(51) Int. Cl.
*A41D 3/04* (2006.01)

(52) U.S. Cl.
CPC ..... *A41D 3/04* (2013.01); *A41D 2200/20* (2013.01); *A41D 2300/32* (2013.01)

(58) Field of Classification Search
CPC ... A41D 3/04; A41D 3/02; A41D 3/00; A41D 2200/20; A41D 13/1184; A41D 13/00; A41D 1/02; A42B 1/048; A42B 1/18; A42B 1/06; A42B 1/046
See application file for complete search history.

(56) References Cited

U.S. PATENT DOCUMENTS 1,182,210 A * 5/1916 Rosenbaum ..... A42B 1/247 2/10
1,207,440 A * 12/1916 Raudnitz ..... A42B 1/248 D2/879
2,324,722 A * 7/1943 Papierniak ..... A41D 3/00 2/93
3,346,876 A 10/1967 Hutton
4,839,924 A * 6/1989 Laurence ..... A42B 1/247 2/909
5,119,514 A 6/1992 Woehl
6,430,749 B1 * 8/2002 Waheed ..... A41D 1/02 128/869
6,654,963 B2 * 12/2003 Fayle ..... A41D 3/00 2/84
7,188,374 B2 3/2007 Carey
(Continued)

OTHER PUBLICATIONS

Photos of traditional cuff construction, commercial product available at least as early as Dec. 2021.
(Continued)

*Primary Examiner* — Jillian K Pierorazio
(74) *Attorney, Agent, or Firm* — Pedersen and Company, PLLC; Ken J. Pedersen; Barbara S. Pedersen

(57) ABSTRACT

A garment hood has flip-up brim that shields and re-directs rain and moisture. The brim is above and distanced from the hood face opening and serves as an eave to redirect the water. Water flows behind the raised brim to a gutter at the connection of the brim to the hood, and then flows to the right and left away from the face opening. Water flows forward and off the front edge of the lowered brim, and also off the right and left eave ends that are farther to the right and left than the right and left extremities of the face opening. The garment may also include an adjustable cuff with an opening larger in diameter than the lower sleeve so that a narrow region is formed between the cuff and the lower sleeve so that minimal or no sleeve forearm fabric folds during cuff closure.

15 Claims, 18 Drawing Sheets

(56) References Cited

U.S. PATENT DOCUMENTS

| | | | | |
|---|---|---|---|---|
| D595,032 | S | 6/2009 | Lopiccolo | |
| 7,681,251 | B2 | 3/2010 | Carey | |
| 2002/0059674 | A1* | 5/2002 | Blauer | A41D 3/04 2/87 |
| 2011/0131711 | A1 | 6/2011 | Kuchuris et al. | |
| 2013/0125292 | A1 | 5/2013 | Weaver et al. | |
| 2014/0208482 | A1* | 7/2014 | Asbury | A42B 1/18 2/172 |
| 2015/0057621 | A1* | 2/2015 | Coombs | A42B 1/18 604/289 |
| 2016/0015108 | A1* | 1/2016 | Bertron | A42B 1/06 2/424 |
| 2016/0060870 | A1* | 3/2016 | Martin | E04D 13/064 52/12 |
| 2017/0079359 | A1 | 3/2017 | Chase | |
| 2018/0193687 | A1* | 7/2018 | Petrakis | A63B 21/4005 |
| 2018/0271189 | A1* | 9/2018 | Hussey | A41D 13/012 |
| 2021/0052022 | A1* | 2/2021 | George | A41D 27/24 |
| 2024/0122282 | A1* | 4/2024 | Cronin | A41D 31/06 |

OTHER PUBLICATIONS

Photos of traditional sleeve and cuff construction, commercial product available at least as early as 2010.

* cited by examiner

FEATURES FOR OUTDOOR AND STORM-PROTECTION CLOTHING

This application claims benefit of Provisional Application Ser. No. 63/420,149 filed Oct. 28, 2022, the entire disclosure of which is incorporated by this reference.

BACKGROUND OF THE DISCLOSED TECHNOLOGY

Field of the Disclosed Technology

The invention relates to improvements in clothing, and more specifically for outdoor clothing that is beneficial for use in wet weather and storms. The improvements may comprise one or both of: a hood with a water-directing brim, and/or a low-profile cuff adapted for relative tightening and loosening of the cuff. The invention therefore may comprise in certain embodiments the water-directing brim or the hood it is on, and/or the adjustable cuff, or in other embodiments, a piece of clothing having one or both of these improvements.

RELATED ART

Traditional outdoor jackets for hunting, skiing, or other recreational or sporting use may include a hood that is conventionally placed over other headwear, such as a cap having a single brim that is fixed into one position. Depending on head size and the type of the headwear, the user's field of view may be inhibited, or the hood may conflict with the headwear, creating discomfort and diminishing functionality/usability of the hood. Further, if a traditional brim is provided on the outdoor hood, the hood is conventionally part of, or extends from, the edge of the face opening. Thus placed, the traditional brim has minimal water redirection capability to prevent water from falling into the face opening, and especially has minimal or no capability to prevent water from falling into the right and left regions of the hood opening.

Traditional outdoor jackets for hunting, skiing, or other recreational or sporting use typically have cuffs that adjust in diameter to tighten or loosen the cuff on the wearer. A conventional cuff is formed by a fabric panel being connected at its two edges along its length, to form a sleeve cylinder having a longitudinal seam. The distal end of the cylindrical sleeve therefore may be described as a cylindrical or circular cuff. The seam may be described as connecting folded panel edges abutting together at the seam, that is, connecting folded edges of panels that abut together wherein the panels are co-planar as is known in conventional sewing methods. Conventional adjustment of such cuffs is provided by a tab that is sewn into the longitudinal seam so that the tab extends radially out from the circumference of the cuff, whereby the resulting seam comprises at least three panels of fabric (two edges of the cylinder panel plus the tab edge) connected together in a thick, bulky seam. For example, a first piece of hook-and-loop fastener is attached to one side of the tab and a cooperating second piece of hook-and-loop fastener is attached to the outer circumferential surface of the cuff a distance from the tab and a distance from the seam, so that there is an intermediate cuff portion between the tab and seam and the second piece of fastener.

To tighten and fasten the conventional cuff, the user typically pulls the tab in a first circumferential direction toward and onto the second piece of fastener by folding the cuff, specifically the intermediate cuff portion about midway between the two fastener strips. It is difficult to control the location where the intermediate cuff portion folds, as said intermediate cuff portion is composed of fabric and thread without fasteners or stiffeners on/in said intermediate cuff portion, so the folding and fastening step(s) tend to be inaccurate and/or difficult. Folding of the cuff serves to reduce the diameter of the cuff, but the cuff in the region of the tab seam and the folded intermediate cuff portion is thick and bulky due to the additional, "stacked" materials in said region.

Further, a conventional sleeve to which the conventional cuff is attached is typically cylindrical along most of its length, especially near the cuff, so that there is a diameter of the sleeve directly above the cuff that is substantially larger than the diameter of the cuff when the cuff is tightened. Therefore, the fabric of at least the lower sleeve (aka sleeve forearm) also folds over, as a result of, and to accommodate, the folding of the cuff to tighten the cuff. This folded-over sleeve forearm fabric is bulky and protruding, and therefore is problematic for movement and/or operation of a hunting bow or other weapons or equipment. This folding may potentially create hazardous conditions as the folded-over sleeve fabric catches on, or otherwise interferes with, equipment the wearer is carrying or using, for example, bow and arrows, a firearm, skis and ski poles, etc.

SUMMARY OF THE INVENTION

Features that are especially beneficial for outdoor and storm-protection clothing are disclosed and may comprise one or both of: a water-directing brim for a hood and/or a low-profile cuff for convenient tightening of the cuff without significant folding over of sleeve fabric. The invention therefore may comprise in certain embodiments the water-directing brim or the head-cover/hood it is provided on, the adjustable cuff, or, in other embodiments, a piece of clothing having one or both of these improvements.

Improved hoods according to certain embodiments may comprise a brim that is located and structured so that it directs water away from the opening and the wearer's face. Preferred embodiments of the improved brim are located above, and distanced from, the face opening of the hood, and are conveniently movable between two positions. In a first, raised position of the brim, water flows between the raised brim and the forehead region of the hood and then flows to the right and left to flow out from the space between the brim and the forehead, at or near right and left eaves (or "right and left eave ends") of the brim, and down from the hood, that is, the water flows substantially or entirely behind, and to right and left of, the hood face opening. In a second, lowered position of the brim, the brim shields the user's face from sun, and also from rain and other moisture by directing the rain/moisture to run off the brim at the front of the brim and also right and left off of the right and left eave ends that protrude out past the right and left extremities of the hood opening.

Therefore, objects of certain embodiments of the brim may include providing a versatile moveable brim that is above and distanced from a face opening, curved, and right-and-left-extending beyond the right-and-left extremities of the face opening, to shield the face opening and direct water away from the opening, to protect the user and his/her underlying clothing, from water, snow and sun while minimizing interference with the user's view. Another object of certain embodiments of the brim is to have limited or no folded-and-stitched seams, and/or to use adhesive instead of sewn seams or stitching at certain locations that are important in reducing bulkiness and/or providing water-resistance or waterproofing.

In certain embodiments, improved cuffs may be provided on a garment at an opening that requires the opening to be larger for passing-through of an object before tightening it down, for example, on sleeves, pants, gloves, or gauntlets. These improved cuff embodiments may be provided on a garment that provides excellent storm protection, for example, on a jacket with a hood with a water-directing brim. The adjustable cuff is adapted to have a low-profile, meaning the profile that is non-bulky and sleek in appearance, water-resistant or water-proof, and easy to tighten to positions desired by the wearer for limiting/preventing rain, snow, or wind from entering into the sleeve. In preferred embodiments of the cuff, the adjustment mechanism of the cuff is integrated into the circumference of the cuff opening itself, so that material bulk is reduced and a cleaner, lower profile opening with less material stacking is produced.

In certain embodiments, the sleeve on which the cuff is installed may be described as "conical" rather than cylindrical, wherein the sleeve is substantially tapered to have a smaller diameter especially at/near the cuff. Preferably, tapering is provided on at least a portion of the upper sleeve and preferably on all of the lower sleeve/forearm down to the junction with the cuff. This tapering results in a "waist" at the junction of the sleeve with the cuff, and the amount of sleeve fabric that is folded over when the cuff is tightened is greatly reduced or eliminated. For example, when unfastened/open, the cuff opening diameter is larger than the diameter of the sleeve just above the cuff, so the cuff circumference may be tightened to reduce its diameter by folding the cuff circumference with little or no folding of the forearm sleeve. This reduction/elimination of folded sleeve forearm fabric reduces/eliminates bulk and the potential hazard and/or inconvenience of folded-over sleeve fabric catching on, or otherwise interfering with, equipment the wearer is carrying or using, for example, a firearm, bow and arrows, skis and ski poles, etc. Another object of certain embodiments of the adjustable cuff comprises providing a non-bulky and water-resistant/proof cuff with specially chosen placement of a stiffener or a stiff fastener on the cuff circumference, so that the cuff circumference tends to fold easily, at an edge of that stiffener or stiff fastener, to a cuff diameter that is desirable for many users.

BRIEF DESCRIPTION OF THE DRAWINGS

In FIG. 1, the brim is in a lowered position, the right-sleeve cuff (at the left of the figure) is tightened at least to some extent and fastened, and the left-sleeve cuff (at the right of the figure) is unfastened.

Figure 1:
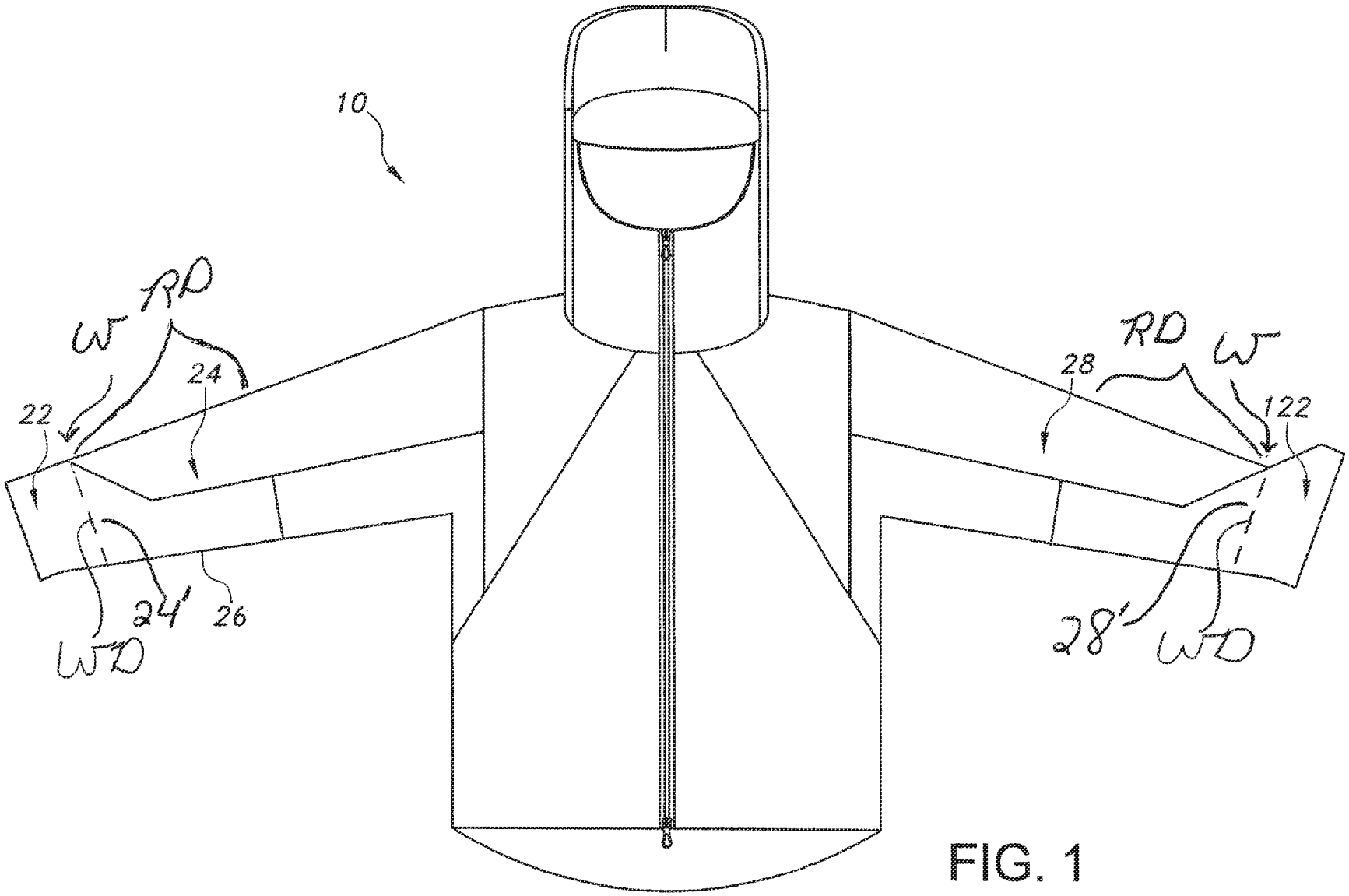
FIG. 1 is a front view of a garment, specifically an embodiment of a jacket, that includes one but not the only embodiment of the invented hood with adjustable, water-directing brim (also "brim system") and one but not the only embodiment of the invented cuff and adjustment system (also "cuff system").
Figure 3:
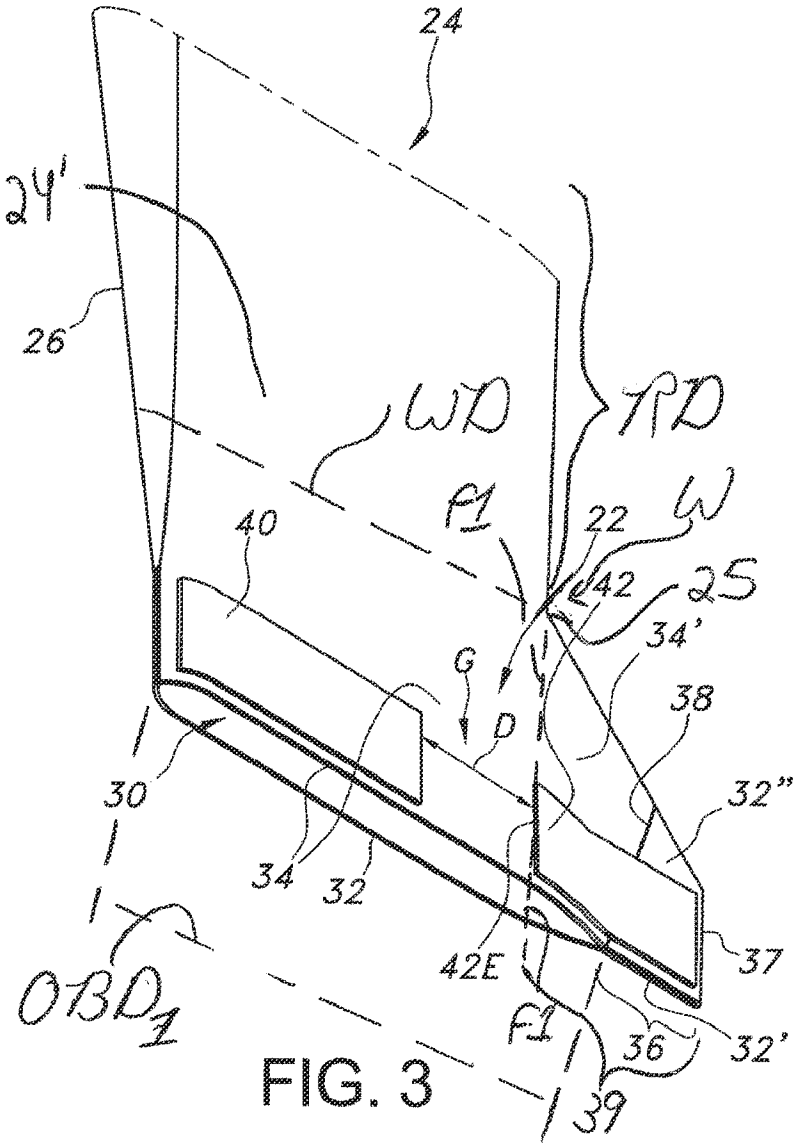

Figures Relating Specifically to Adjustable Cuff Embodiments:

FIG. 3 is a perspective back view of a distal end of the right-sleeve of the jacket of FIG. 1, after unfastening the cuff. The bottom side of the right-sleeve in FIG. 1 is at the left in FIG. 3.

Figure 2:
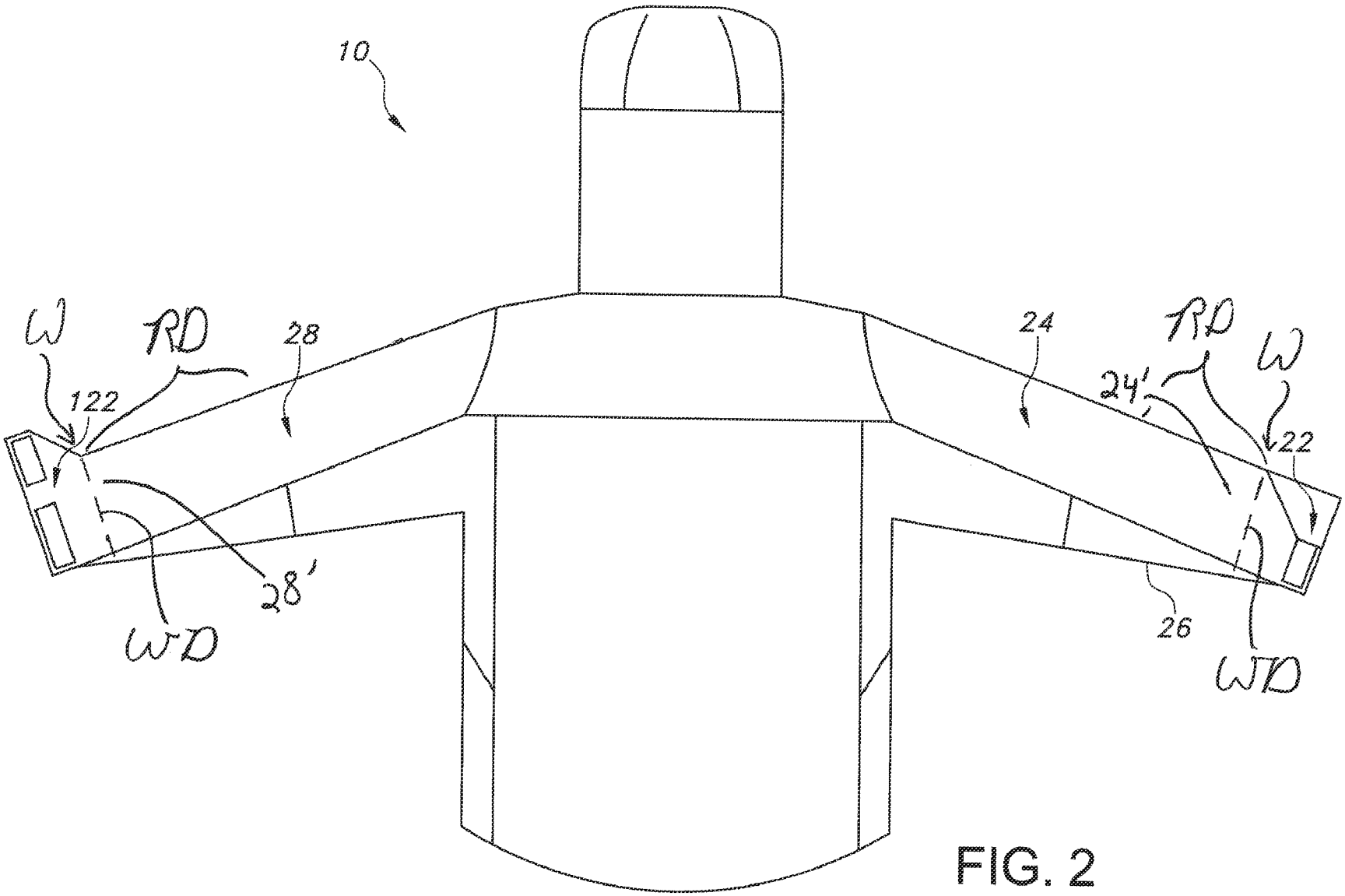
FIG. 2 is a back view of the jacket of FIG. 1, wherein the brim is not visible, the back of the fastened right-sleeve cuff is visible at the right of the figure, and the back of the unfastened left-sleeve cuff is visible at the left of the figure.
Figure 4:
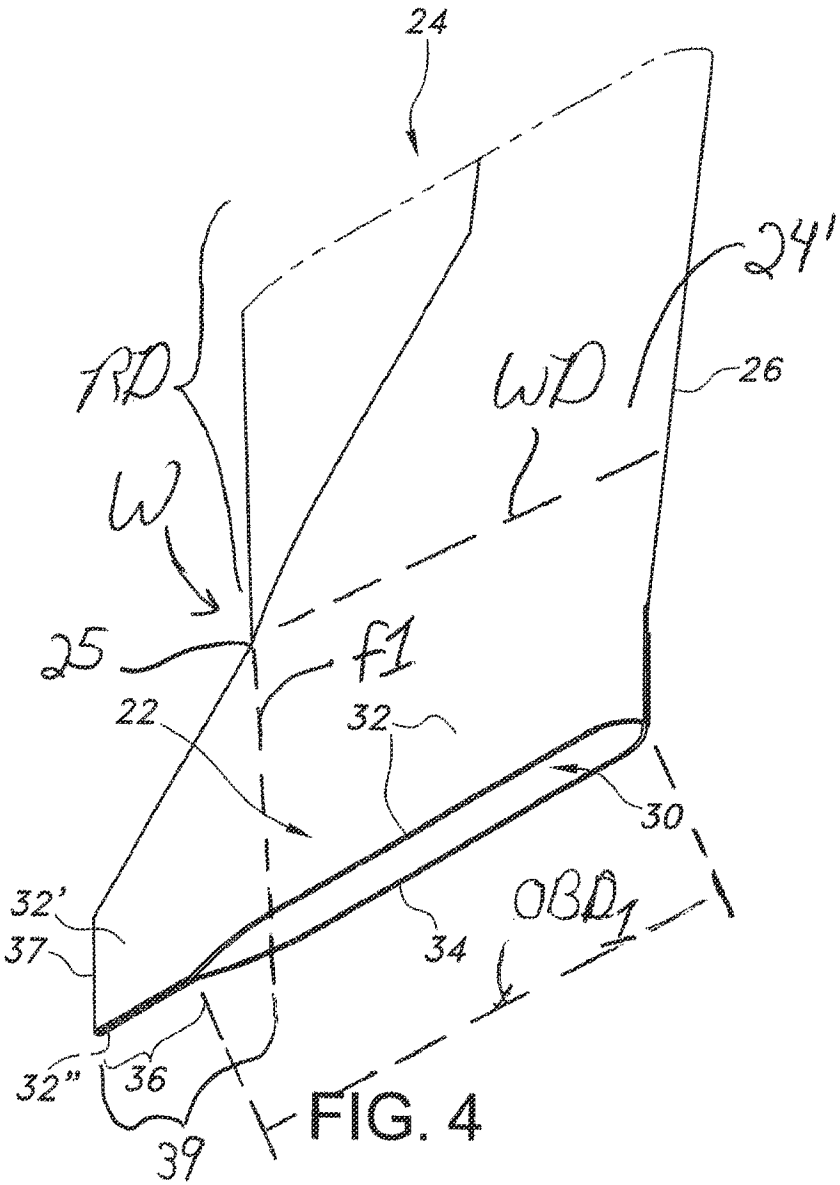

FIG. 4 is a perspective front view of the distal end of the sleeve and unfastened cuff of FIG. 3. The bottom side of the right-sleeve of FIG. 2 is at the right in FIG. 4.

Figure 5:
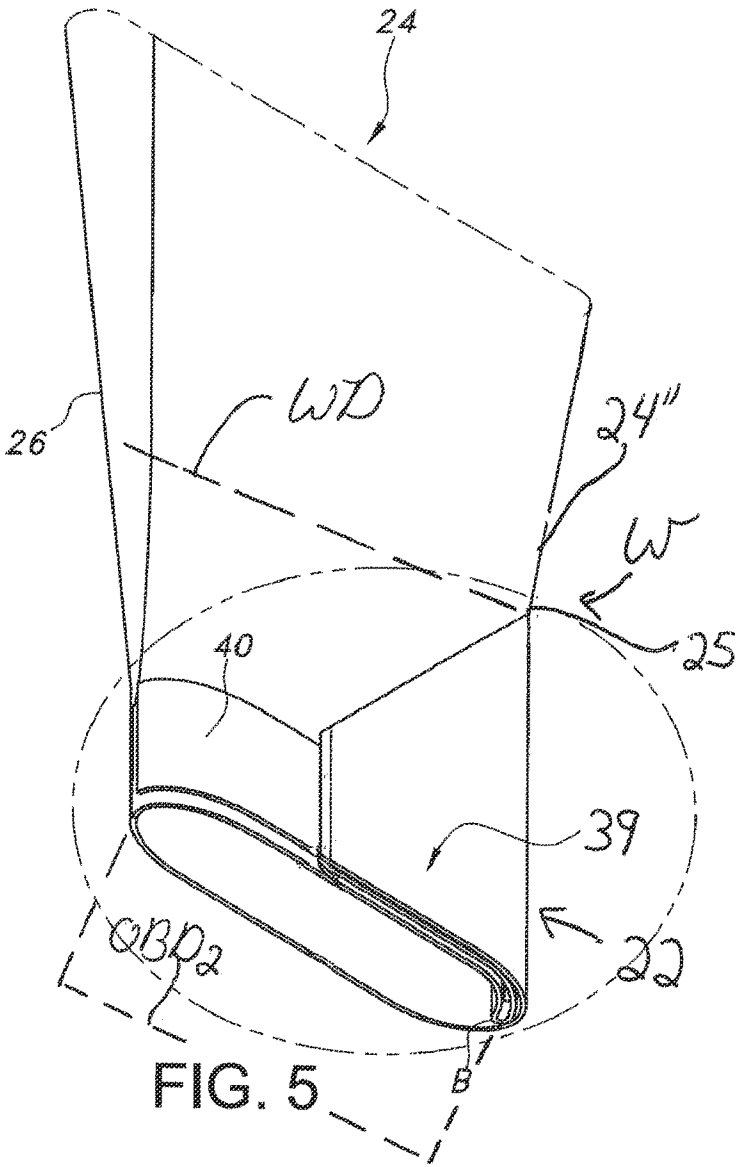

FIG. 5 is a perspective rear view of the distal end of the sleeve and cuff of FIG. 3 after partially-tightening and fastening the cuff, wherein the bottom side of the right-sleeve is at the left of FIG. 5.

Figure 6:
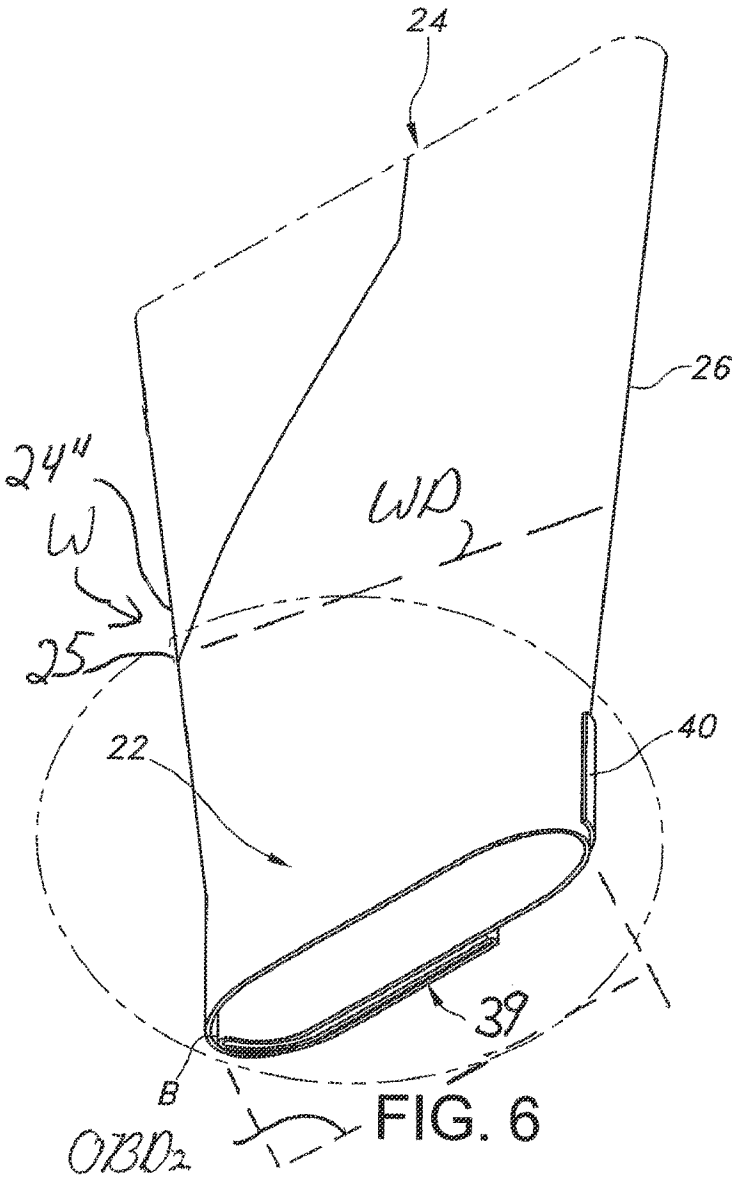

FIG. 6 is perspective front view of the distal end of the sleeve and partially tightened and fastened cuff of FIG. 5. The bottom side of the right-sleeve is at the right of FIG. 6.

Figure 7:
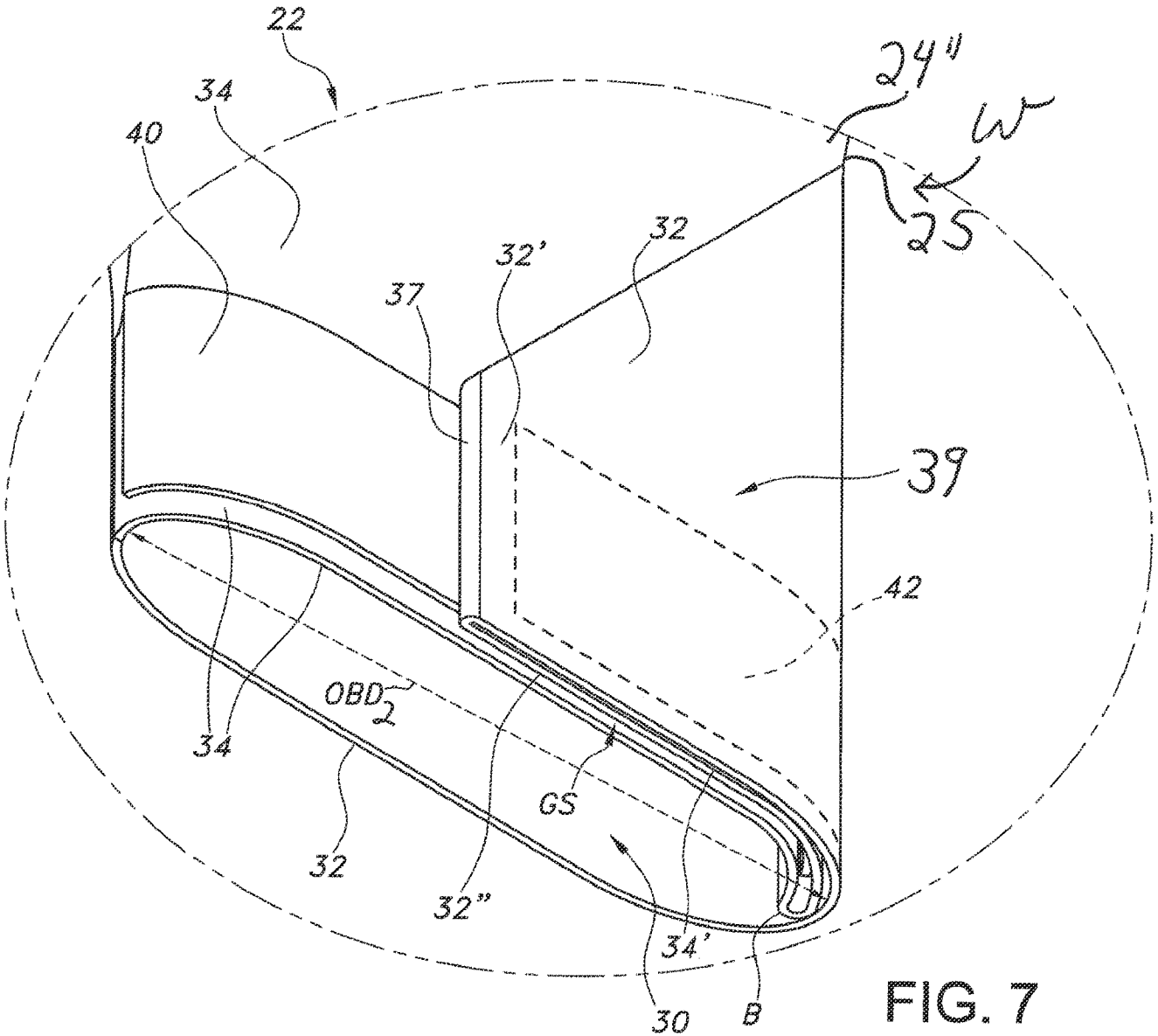

FIG. 7 is an enlarged view of the circled area of FIG. 5.

Figure 8:
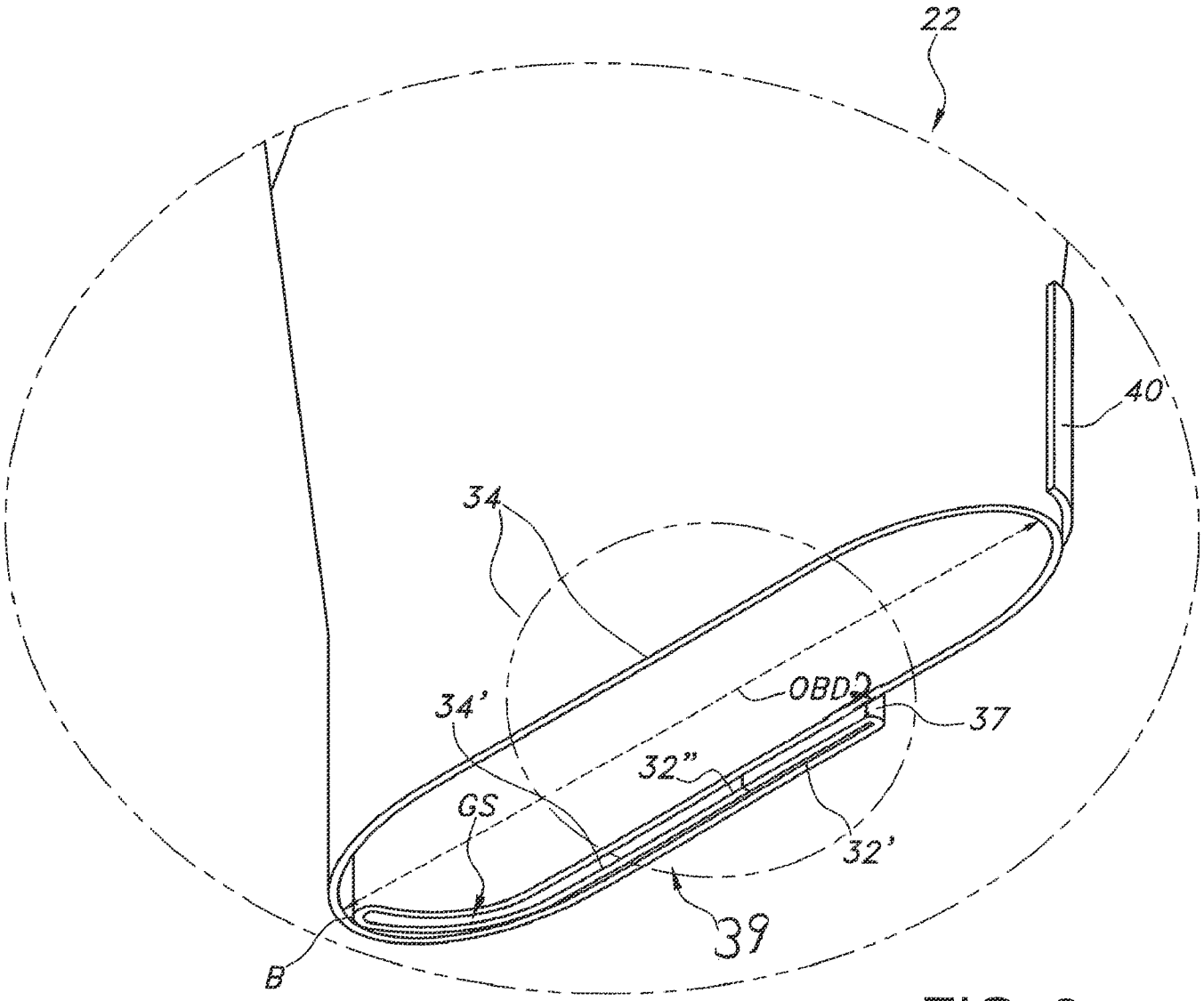

FIG. 8 is an enlarged view of the circled area of FIG. 6.

Figure 9:
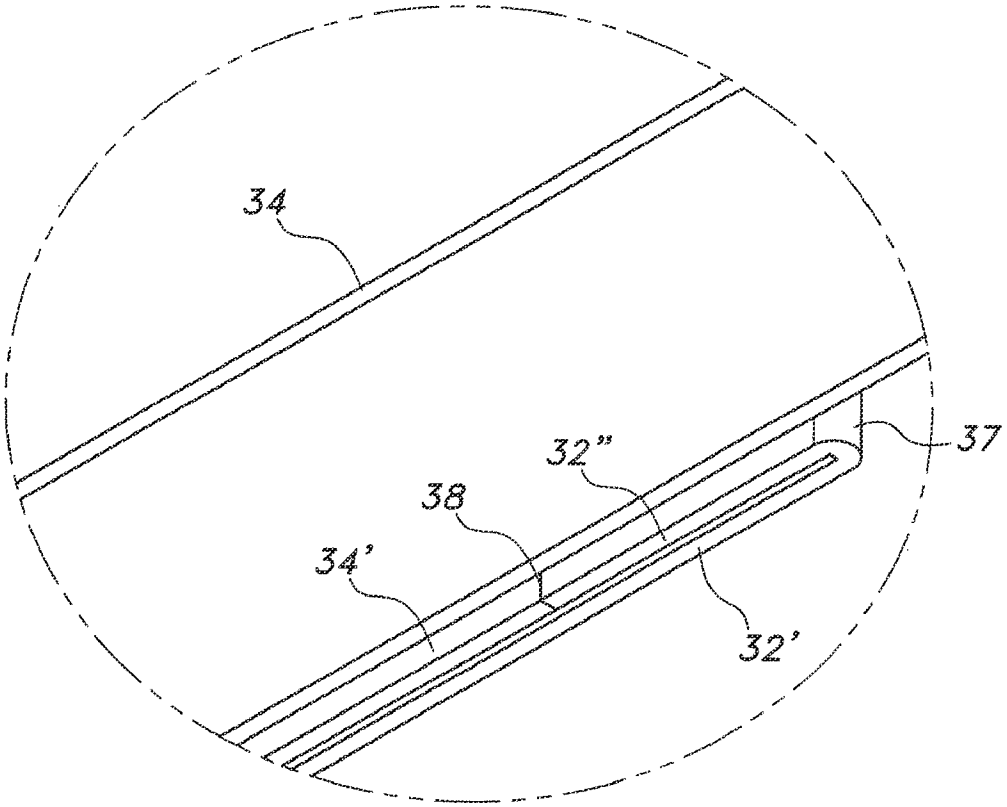

FIG. 9 is an enlarged view of the circled middle region of the cuff of FIG. 8.

Figure 10:
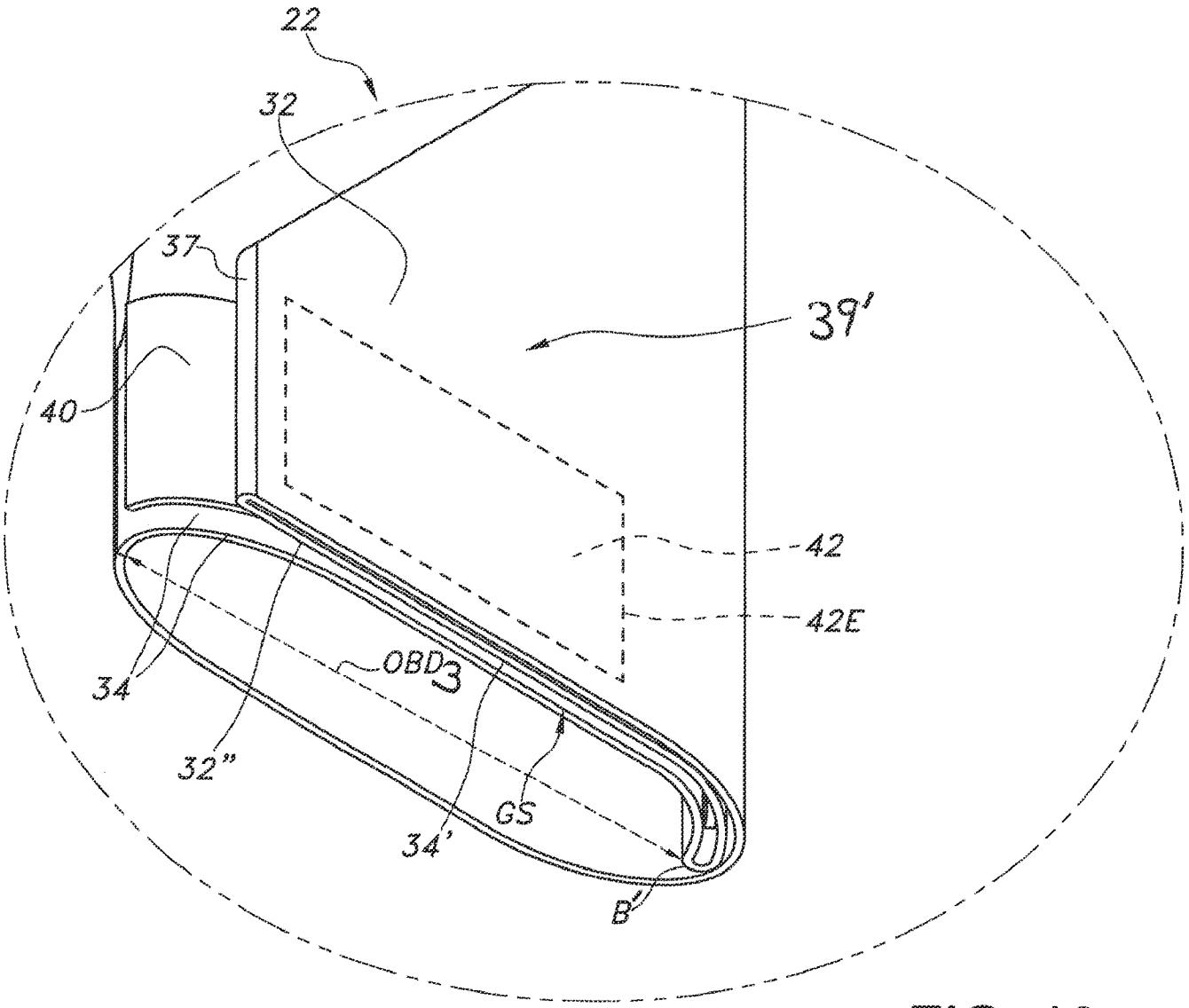

FIG. 10 is an enlarged rear view of the distal end of the sleeve and fastened cuff, which is similar to the view in FIGS. 5 and 7 except that the cuff has been tightened significantly more than in FIGS. 5 and 7 to further reduce the circumference/diameter of the fastened cuff and its opening.

Figure 11:
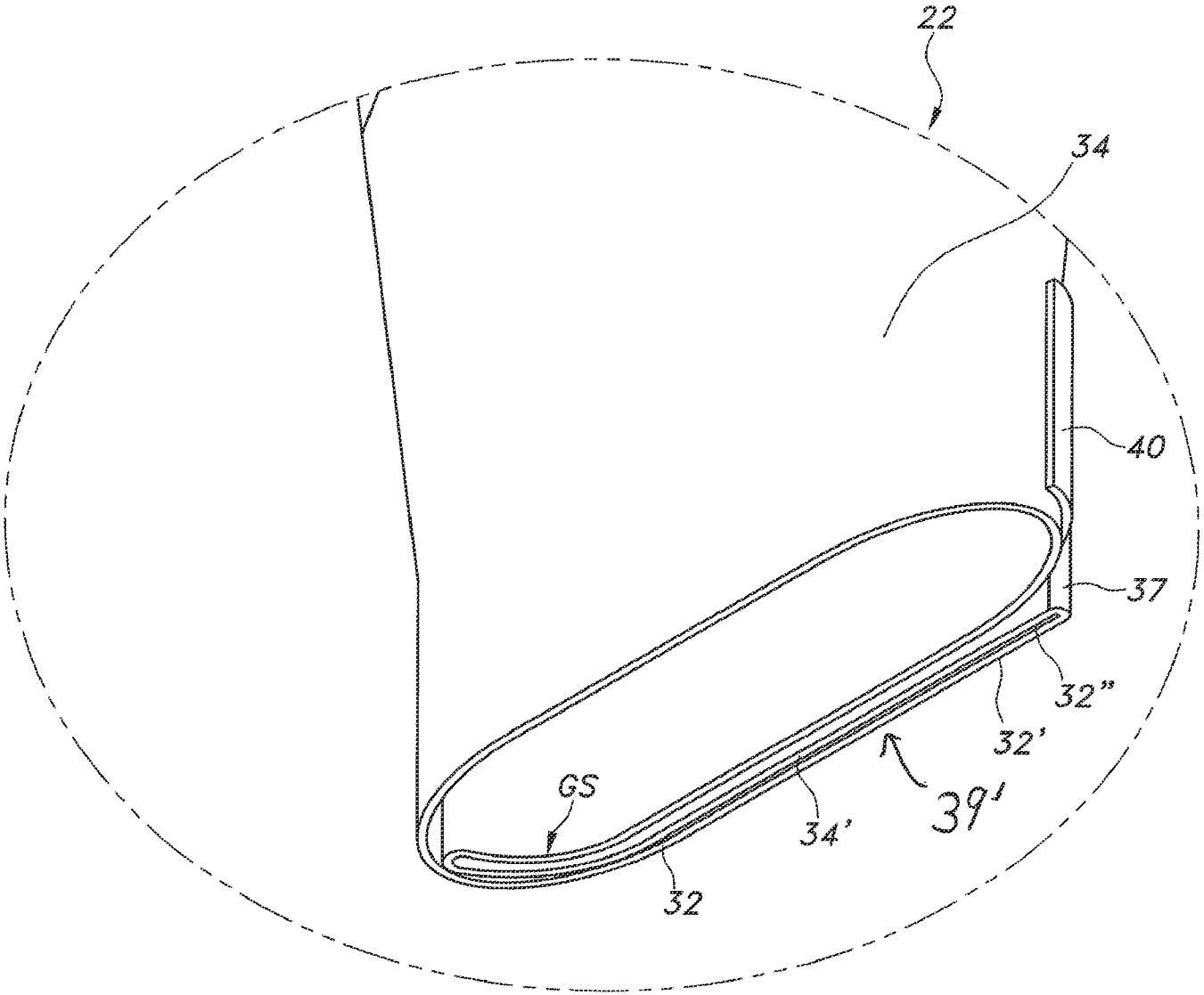

FIG. 11 is an enlarged front view of the distal end of the sleeve and the significantly tightened, fastened cuff of FIG. 10.

Figure 12:
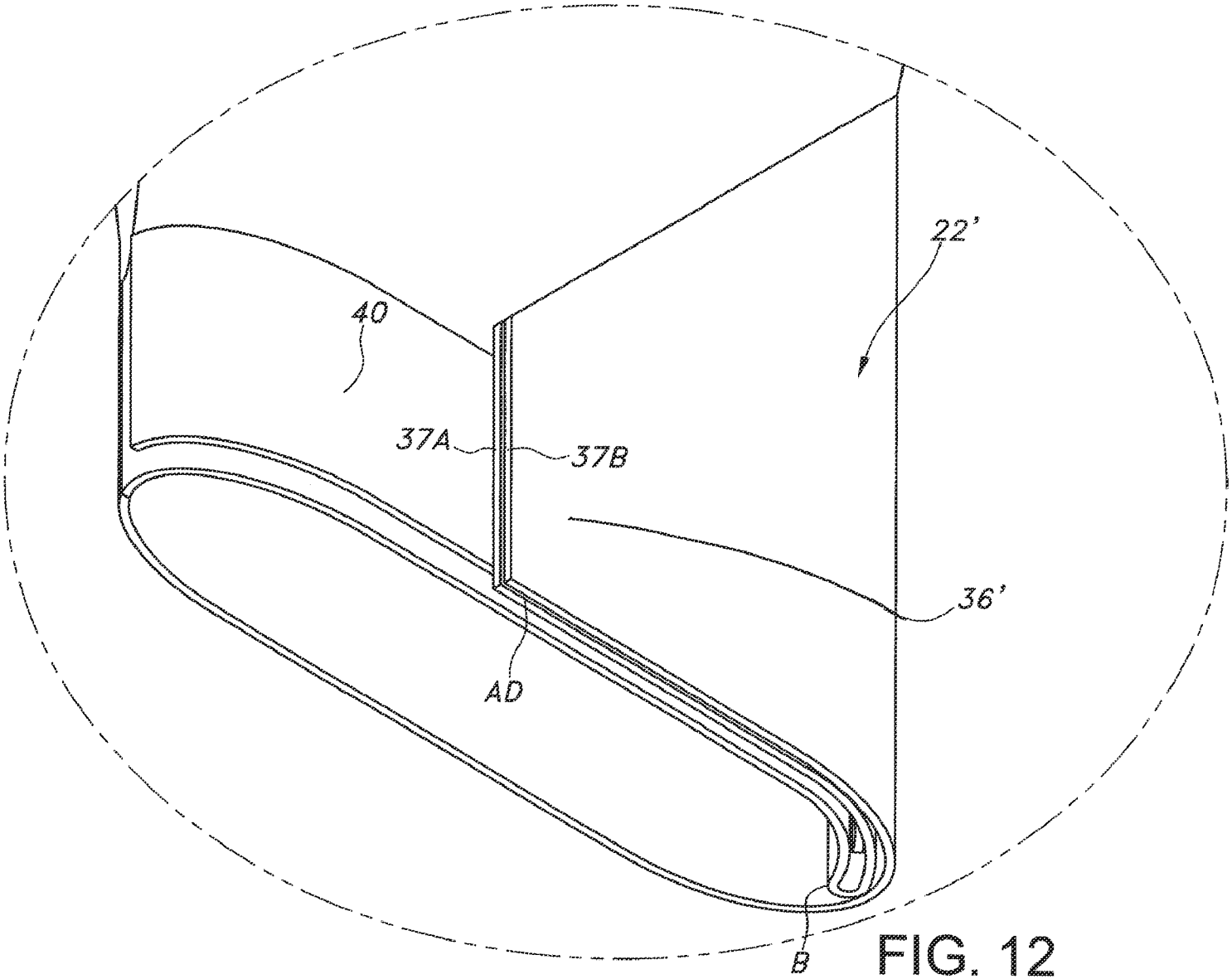

FIG. 12 is a perspective rear view of the distal end of an alternative embodiment of sleeve and cuff, partially tightened and fastened, the cuff, wherein the extension of the cuff comprises two parallel layers of fabric extending parallel all the way to the edge of the extension, with neither of the two parallel layers folding over at the edge of the extension.

Figure 13:
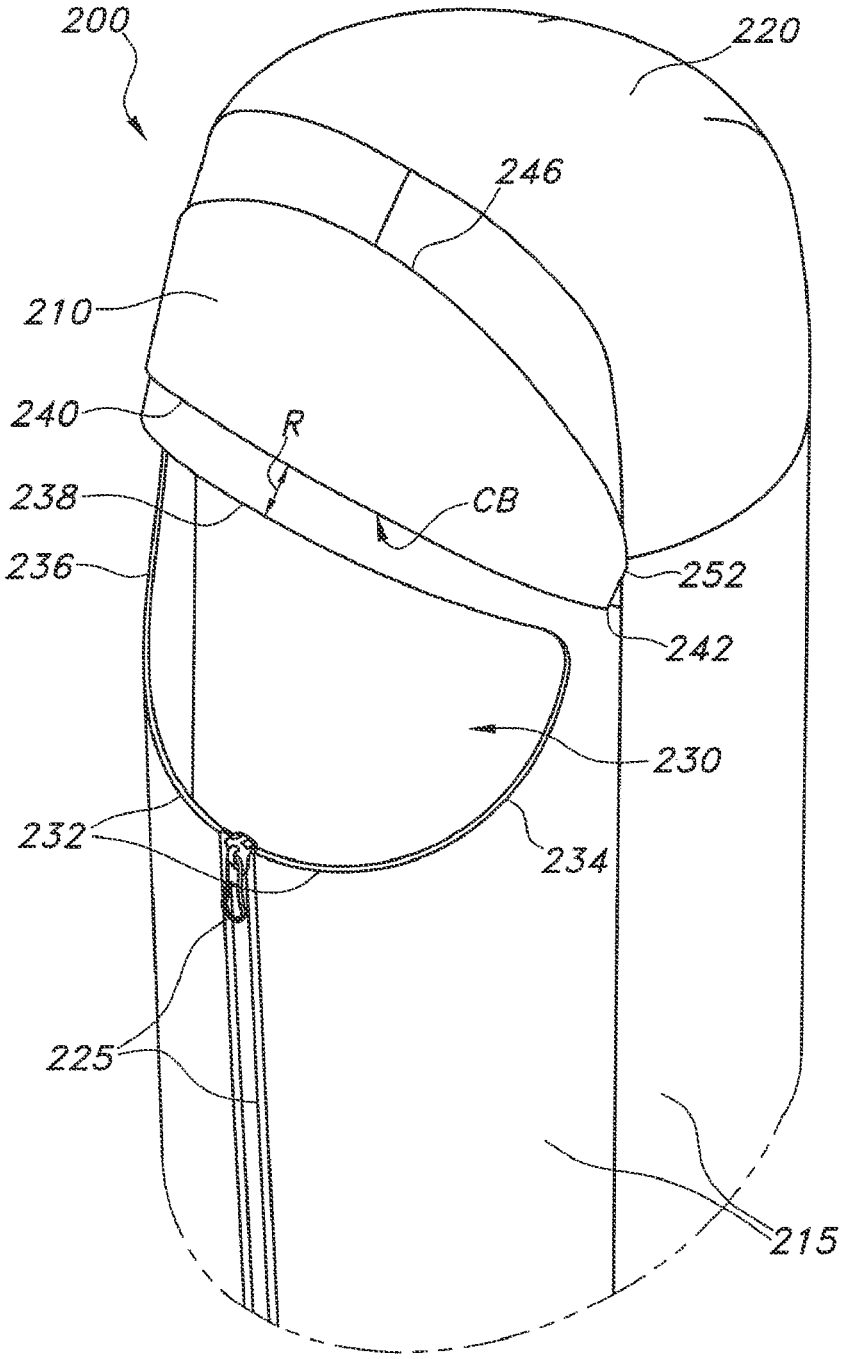

Figures Relating Specifically to Hood with Brim Embodiments:

FIG. 13 is a front-left perspective view of the hood and adjustable, water-direction brim of FIG. 1, with the brim moved to its raised position.

Figure 14:
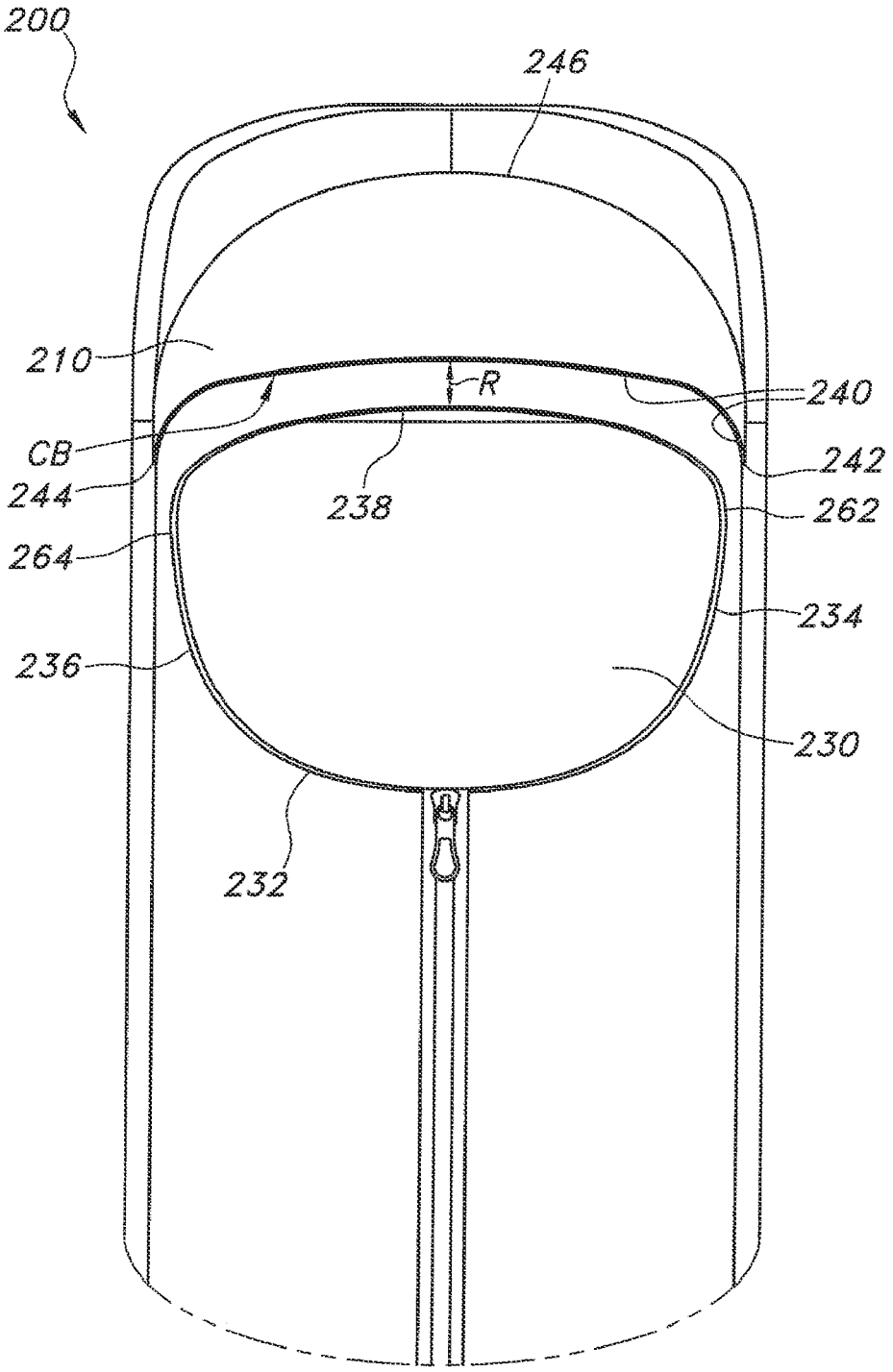

FIG. 14 is a front view of the brim system of FIG. 13.

Figure 15:
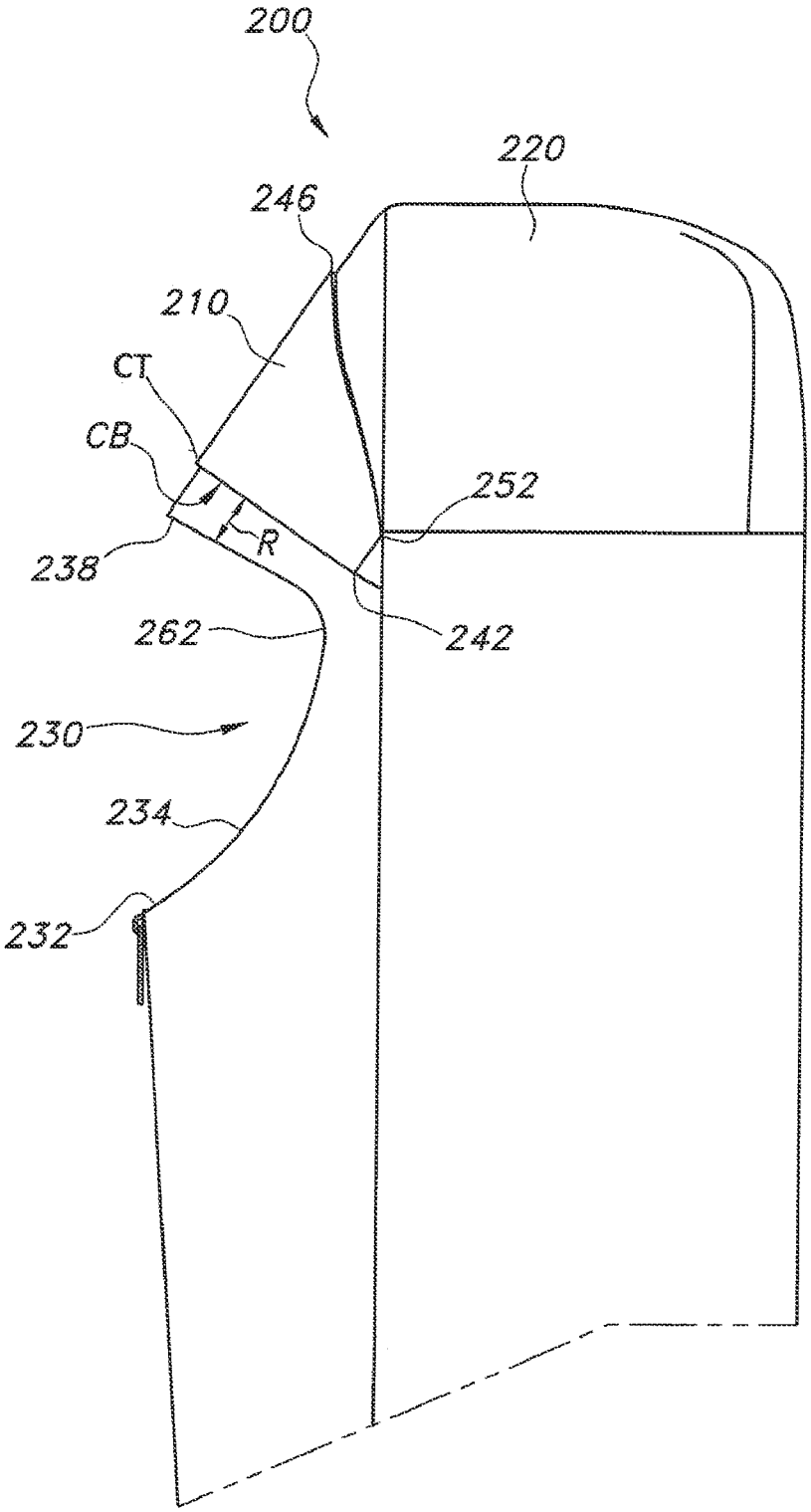

FIG. 15 is a left side view of the brim system of FIG. 13.

Figure 16:
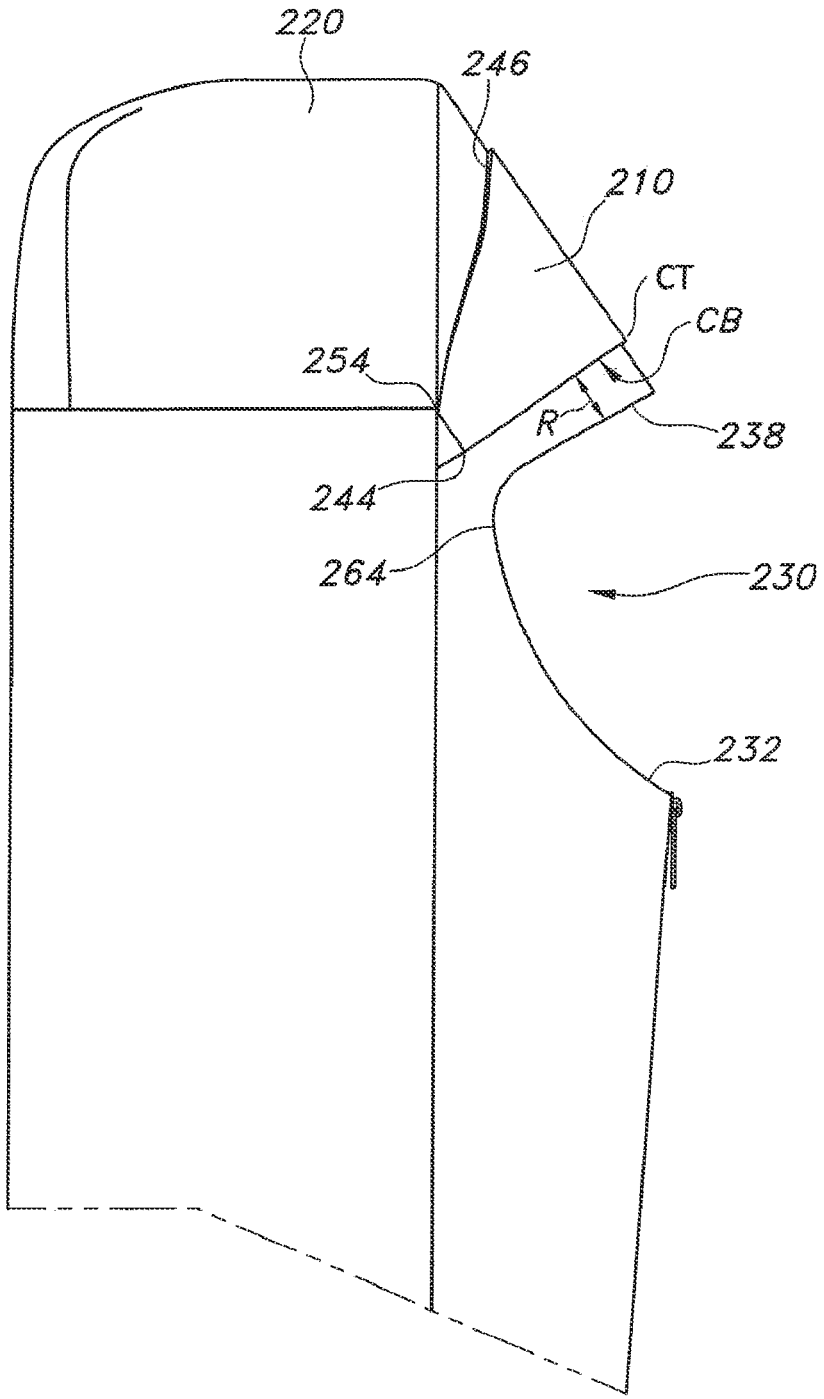

FIG. 16 is a right side view of the brim system of FIG. 13.

Figure 17:
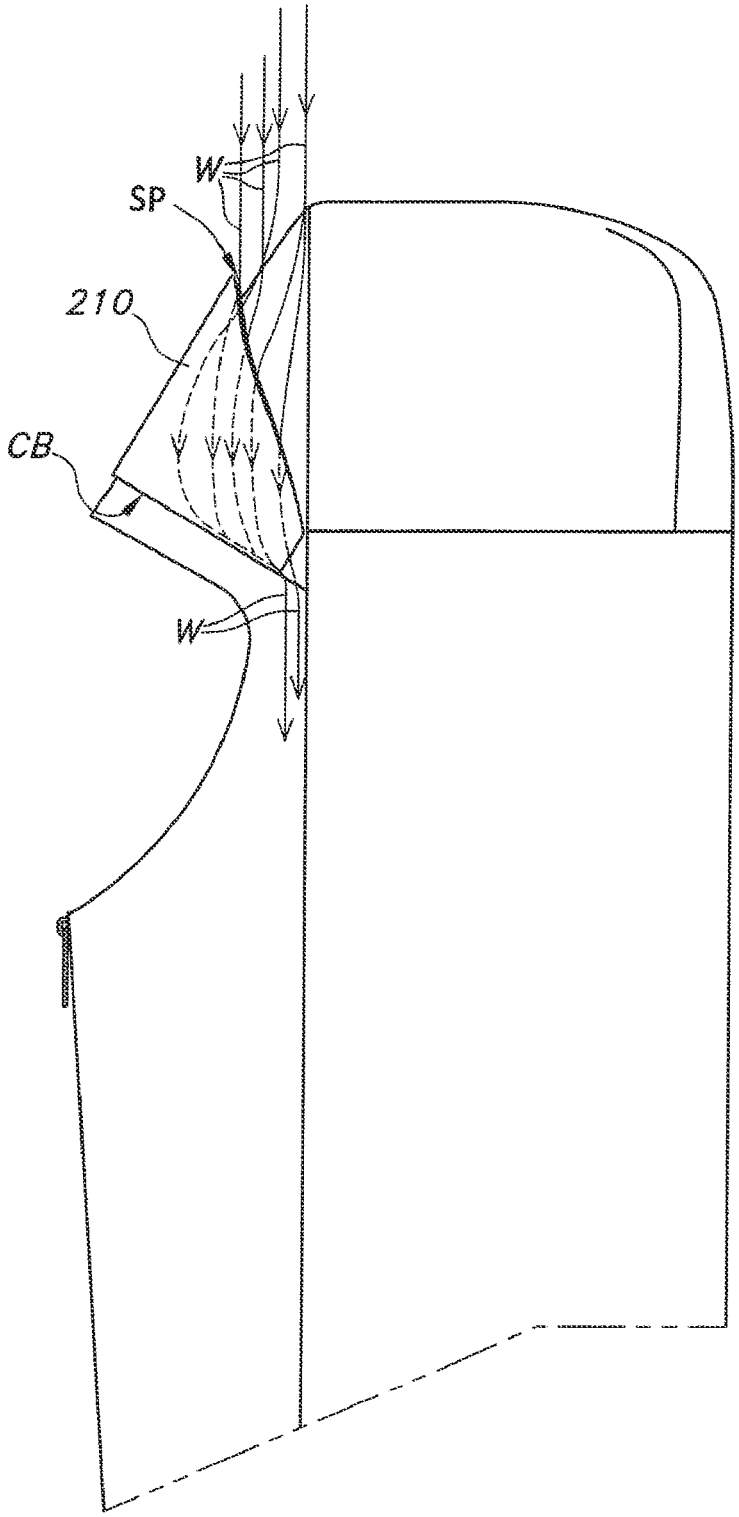

FIG. 17 is a left side view of the brim system of FIG. 13, except with the space between the brim and the hood forehead region increased compared to that in FIGS. 13-16, for emphasis of that space, and with arrows added to schematically show water flow down behind the brim and out the left side of the brim, thus avoiding water reaching the face opening of the hood and the user's face.

Figure 18:
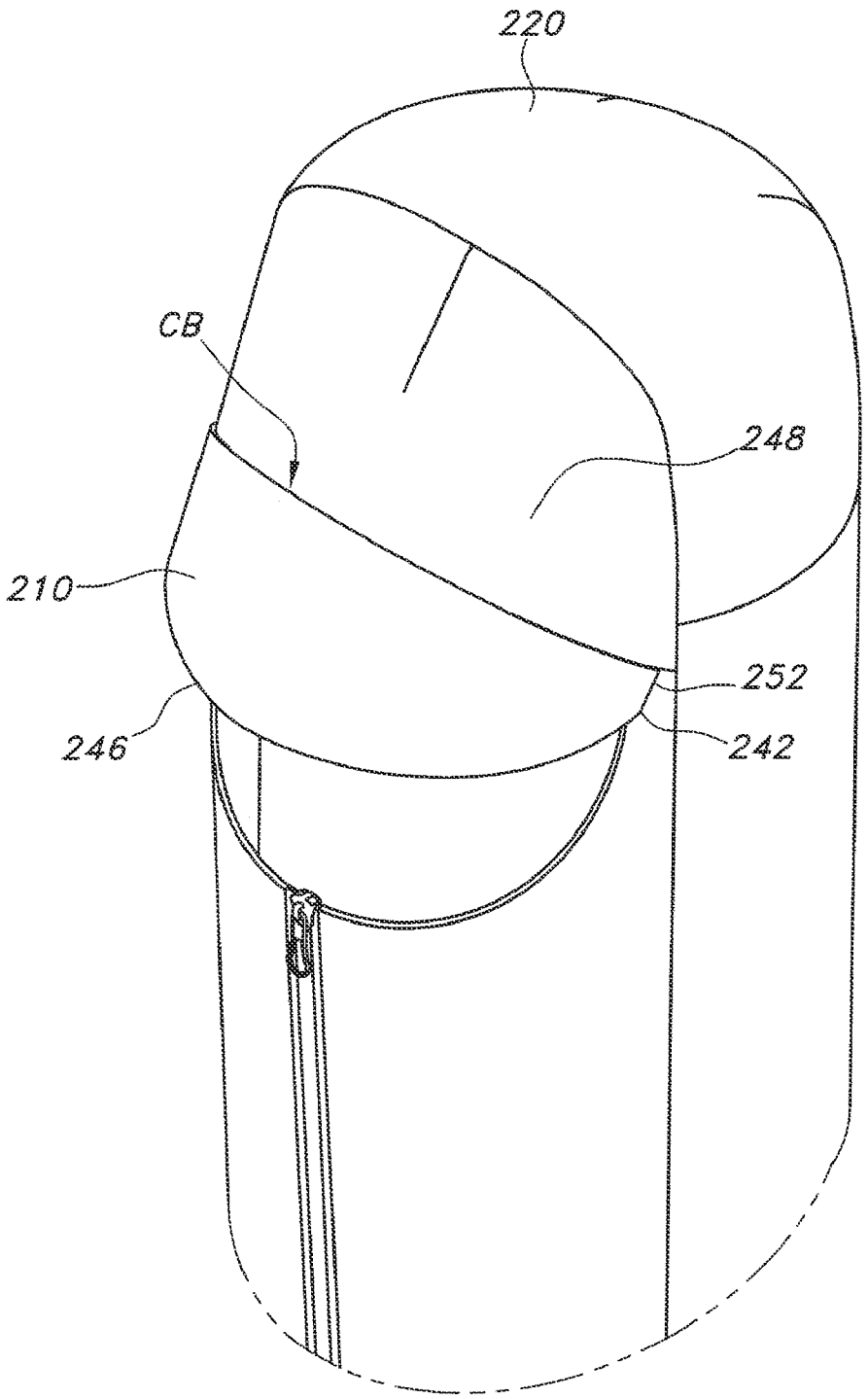

FIG. 18 is a front-left perspective view of the hood of FIG. 13, with the brim moved to its lowered position.

Figure 19:
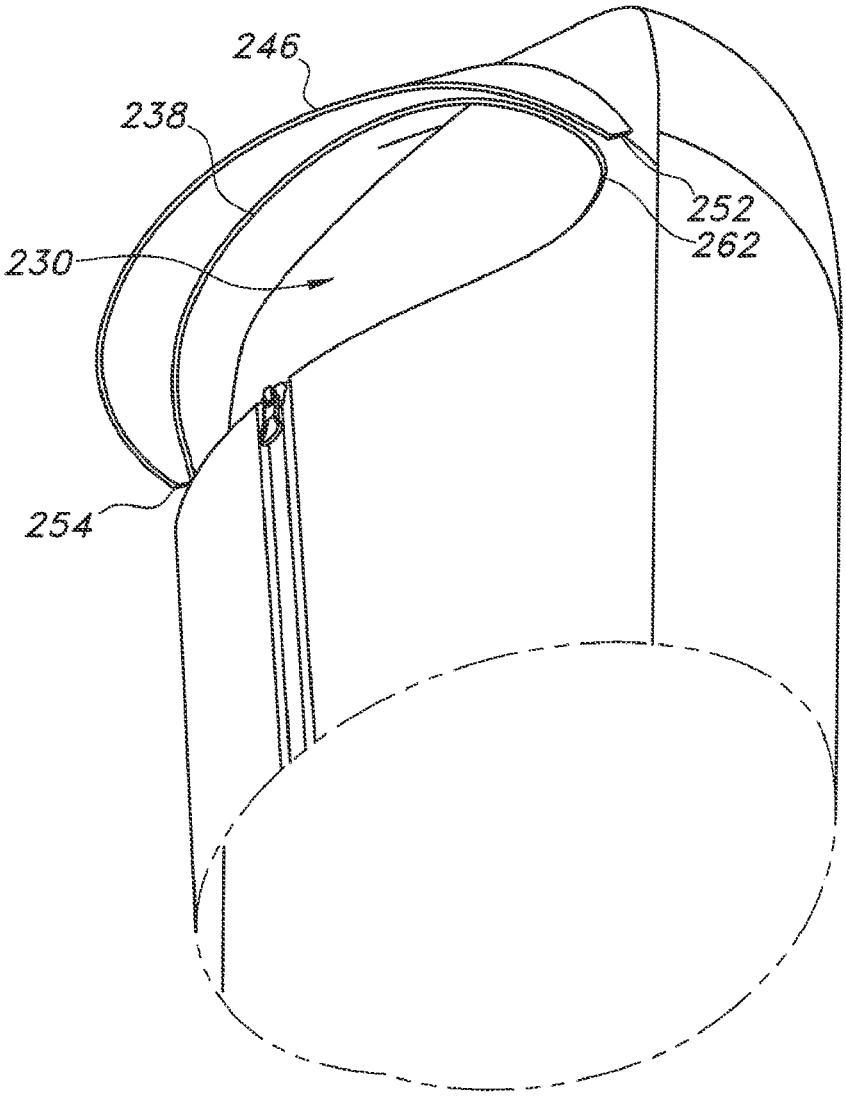

FIG. 19 is a bottom-left perspective view of the hood with lowered brim of FIG. 18.

Figure 20:
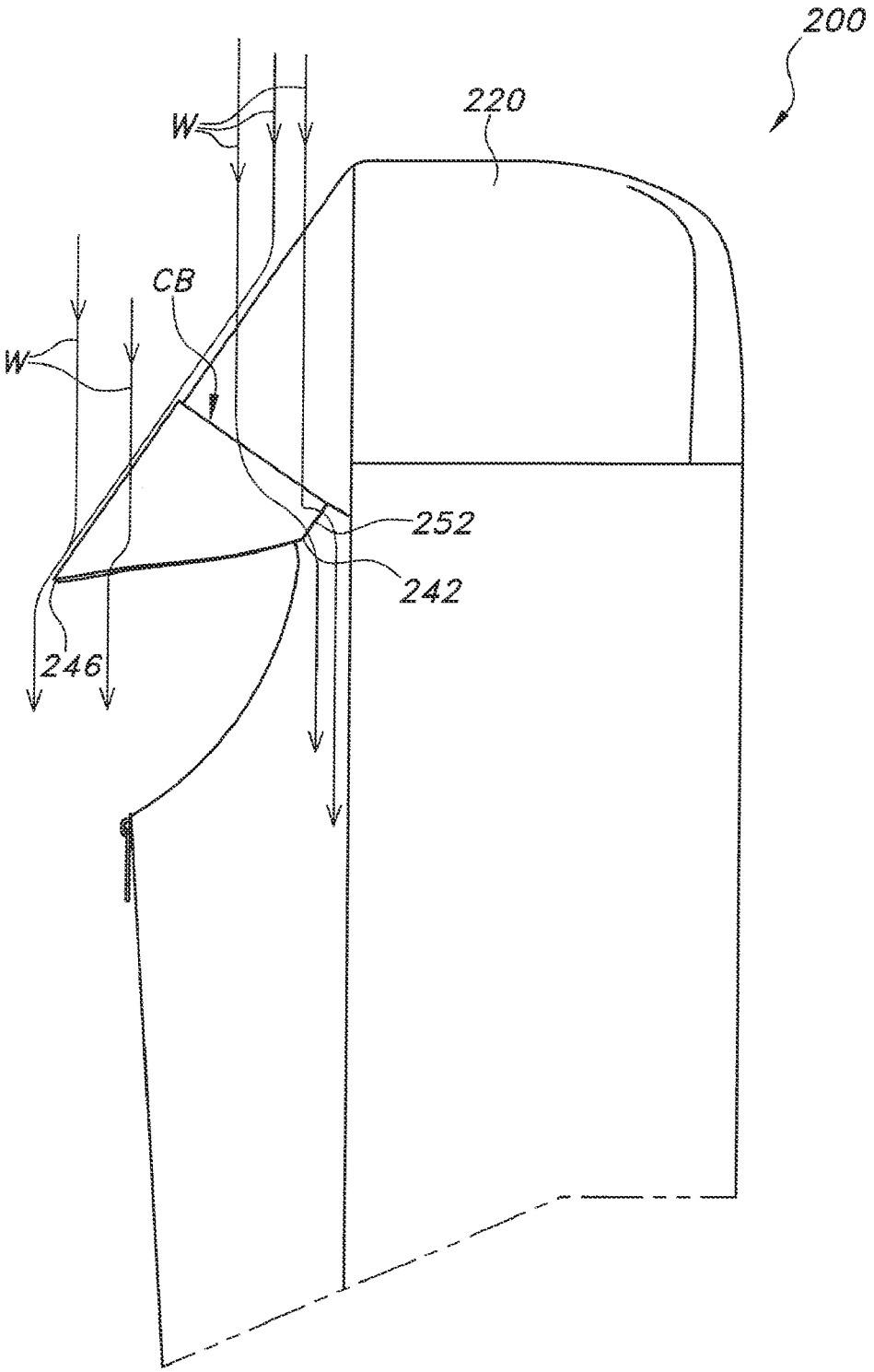

FIG. 20 is a left view of the hood with lowered brim of FIG. 18, with arrows added to schematically show water flow down along the brim to the front and left eave edges of the brim, thus avoiding water reaching the face opening of the hood and the user's face.

DETAILED DESCRIPTION OF CERTAIN EMBODIMENTS

General Description of Certain Embodiments Comprising Adjustable Cuff Improvement:

One or more cuffs according to certain embodiments of the disclosed technology may be provided on any piece of clothing (or "garment") having an opening that requires a larger opening to pass an object through before tightening it down, for example, on sleeves, pant legs, gloves, or gauntlets. The disclosed technology provides a low-profile, non-bulky, sleek-in-appearance garment cuff that is easily tightened and fastened on a sleeve that is folded to little or no extent even when the cuff is tightened and fastened. The disclosed technology provides a cuff wherein an adjustable opening utilizes a portion of the circumference of the opening to also operate as the adjustment mechanism. In preferred embodiments, the adjustment mechanism of the cuff is therefore integrated into the circumference of the cuff opening itself, and so material bulk is reduced, producing a cleaner, lower profile opening with less material stacking.

Adjustable cuffs are particularly important on outdoor garments such as recreational and hunting jackets. In the preferred embodiments, no separate tab is connected to a circular circumference of the cuff, especially no tab is sewn into a seam forming the cuff into a cylinder. Instead, a part of the circumference of the cuff itself is provided with a fastener to connect to a fastener on another portion of the circumference of the cuff for easy adjustment of the circumference and diameter of the cuff. The disclosed construction thus creates a "gusset" of fabric covered by the "flap" that is formed by the extension plus a portion of the cuff circumference. The gusset is of different lengths depending on the amount of cuff circumference adjustment. The gusset is thin due to the thinness of the parallel panels making up the gusset, whereby the gusset may be considered hidden and adds very little cuff thickness between the wearer's skin and the outside surface of the cuff. In the Drawings, the disclosed technology has been applied to the wrist cuff of a jacket, but certain embodiments of the concept can be applied to any opening requiring an open circumference large enough to pass an object with a larger initial circumference that then is reduced in circumference to reduce the opening.

In preferred embodiments, the cuff and sleeve combination is adapted to prevent sleeve fabric above the cuff from being folded over, or to minimize sleeve fabric above the cuff being folded over, when the cuff is folded over on itself for tightening and fastening. This adaptation may comprise: 1) the sleeve being narrow in diameter especially at/near the cuff, and 2) the cuff opening and the cuff extension extending perpendicularly out past the sleeve so that the cuff opening diameter is greater than the diameter of the sleeve at and near the cuff. For example, the sleeve diameter may continuously decrease from the shoulder to the junction where the sleeve joins to the cuff, the junction being called a "waist" that is the smallest sleeve diameter and that is smaller than the cuff opening diameter (OBD1 in FIGS. 3 and 4) and also smaller than the total width of the cuff (OBD1 plus extension 36, in FIGS. 3 and 4). The waist is large enough for a hand to pass through the waist to the opening, and the cuff opening is more than large enough to allow the hand through the opening. As an example, in certain but not necessarily all embodiments for jacket or sleeve cuffs, the cuff opening diameter may be 0.5-2 inches greater than the diameter of the sleeve at the waist, and the outermost extremity of the adjustment extension may extend another 1-2 inches out past the cuff opening, so that the cuff may be described as extending from approximately 1.5 to 4 inches out past the sleeve diameter at the waist.

To fasten the cuff, the user folds over the cuff flap and fastens the cuff flap to the outer surface of the cuff, preferably by pressing together the hook-and-loop fasteners on the cuff flap and the outer cuff surface to connect said flap and surface. This keeps the cuff in the desired fastened configuration for ongoing use of the garment. The size of the cuff flap may vary, depending on how tight the user wishes the cuff to be, with a relatively loose cuff corresponding to the cuff flap being the extension (at the first edge of the cuff) plus the cuff circumference portion that extends out perpendicularly beyond the waist. Or, a relatively tight cuff will result from folding the cuff circumference closer to the second edge of the cuff (edge opposite the first edge), whereby the extension and a greater amount of the cuff circumference is folded over (also "folded over on itself") and fastened by connection of the hook-and-loop fasteners. Fastening the cuff in the relatively loose cuff configuration typically means that the cuff flap fold is at the waist "corner", resulting in very little or no sleeve fabric above the cuff being folded over. Fastening the cuff in the relatively tighter cuff configuration typically means that the cuff flap fold is still close to the waist corner, for example, just 0.5-1 inch inward from the waist corner, resulting in little fabric above the cuff being folded over, for example, just a small fold of fabric extending only a few inches up from the cuff (such as 1-4 inches). In these scenarios, the folded sleeve fabric is zero or minimal, resulting in far less folded fabric and bulk compared to a conventional sleeve and cuff wherein tightly fastening the cuff typically results in fabric up along the entire length of the sleeve or at least up 12 inches from the cuff.

It should be noted that the larger-than-waist cuff circumference diameter may be especially beneficial for outdoor garments. For example, when a wearer puts on gloves after the garment is donned, the wearer can tuck the cuff or gauntlet of the glove into the cuff opening when the cuff is open. This way, after the glove-cuff/gauntlet extends proximally into and through the cuff opening, the wearer may tighten and fasten the cuff around the glove-cuff-gauntlet. This tightening and fastening the cuff serves to reduce the cuff effective diameter and captures the glove-cuff/gauntlet inside the cuff.

Additionally, the cuff-and-sleeve adaptation that minimizes sleeve fabric amount near the cuff, and minimizes sleeve fabric fold-over, is particularly beneficial for garments for outdoor activities, for example shooting, archery, bow-hunting, or skiing. The adaptation minimizes sleeve fabric near the cuff for a given length of sleeve, and minimizes sleeve fabric fold-over to improve the accuracy and/or safety of the activity by preventing the sleeve from catching on/in or otherwise interfering with equipment, for example, firearms, bows, ski-poles, etc. In addition to these utilitarian benefits, the cuff and sleeve combination creates a low-profile, non-bulky, sleek-in-appearance garment sleeve and cuff combination.

Referring Specifically to FIGS. 1-12:

Referring to FIGS. 1-12, there are shown several, but not the only, embodiments of the invented technology. FIGS. 1 and 2 illustrate jacket 10 that includes an embodiment of the cuff system 22, 122 on the right and left sleeves 24, 28, respectively, wherein the right-sleeve cuff 22 is fastened and the left-sleeve cuff 122 is unfastened. The sleeves 24, 28 are both reduced diameter, reduced-fabric embodiments wherein the sleeve diameter is tapered between the shoulder and the cuff to be smaller diameter near the cuff.

The invented technology may comprise a garment, such as the illustrated jacket or other jackets or tops with sleeves, pants of other bottoms with legs, a gauntlet or other glove, etc. The invented technology may comprise, consist essentially of, or consist of, an adjustable cuff with one or more of the cuff features disclosed herein, a combination of the adjustable cuff with a sleeve comprising a reduced-diameter lower sleeve RD, and/or methods of constructing or using the adjustable cuff and/or sleeve. The adjustable cuff and/or sleeve, and methods of construction of the cuff and/or sleeve, may be easily used, comfortable, and sleek in appearance, tending to limit or prevent rain and snow from entering the sleeve interior through the cuff opening, and, as described above, allowing easy insertion and capture of glove-cuffs/gauntlet, and/or limiting sleeve fabric, and/or limiting or eliminating sleeve fabric fold-over upon fastening the cuff, for safety and convenience in outdoor activities.

Preferably, moisture-resistant or moisture-proof fabric/layers, and the lack of any sewn seam in the preferred cuff serve to limit or prevent moisture from soaking into the cuff. The fabric panels forming the cuff are preferably attached/bonded together at the cuff by adhesive or other non-sewing methods, rather than by sewing cuff panels together at seams.

The preferred right and left sleeves 24, 28 and right and left cuffs 22, 122 are constructed to be mirror images of each other. Thus, the right and left cuffs 22, 122 in the unfastened configuration and the fastened configurations are mirror images of each other. Therefore, the left-sleeve in FIG. 1, when unfastened, is a mirror image of the unfastened right-sleeve cuff of FIG. 1.

FIGS. 1-4 shows to best advantage the waist W at the junction between the cuff 30 and the distal end of the lower sleeve 24' 28', with both the junction and the diameter of the waist W being represented by the dashed line for the waist diameter WD. It may be noted that the term "lower sleeve" is used to denote the end of the sleeve that is typically around the forearm and "low" when the wearer's arms are lowered and generally vertical with the hands pointing to the ground/floor. The waist corner 25 at the edge of the junction of the lower sleeve 24' and the cuff 22, and the dashed line F1, denote the location/line at which the cuff fabric tends to naturally fold, along the edge 42E of the fastener strip 42 (FIGS. 3 and 4). This folding at fold line F1 forms cuff flap 39 for the "loosely-fastened cuff" discussed above and shown in FIGS. 5 and 6. Note in FIGS. 5 and 6 that the lower sleeve portion 24" is not folded due to the folding of cuff flap 39, thus, maintaining the same sleek profile of the lower sleeve 24' as is seen in FIGS. 1-4 and preventing a bulky fold that may interfere with hunting or sports as discussed above. Therefore, it may be said that the inner edge 42E of the fastener is positioned at a location on the outer surface of the cuff that places the boundary in alignment (see F1 and waist corner 25 in FIGS. 3 and 4) with the waist diameter so that folding of the cuff at the boundary reduces the cuff diameter to be the same as the waist diameter and does not fold the forearm of the sleeve or reduce the waist diameter relative to the waist diameter when the cuff is in its unfastened/open configuration.

It may be noted that FIGS. 3-12 show the cuff in perspective and with the sleeve somewhat flattened so that the opening is oblong rather than circular. It will be understood that, in use, the flexible fabric sleeve and cuff will be around the arm and wrist of the user and therefore will tend to appear generally cylindrical/circular. In the drawings, however, the somewhat flattened, oblong shape is used to allow the viewer to view more of the cuff front and rear sides.

FIGS. 3 and 4 show the cuff 22 of the right sleeve 24 in unfastened or "open" condition, wherein the bottom side 26 of the right sleeve 24 (as viewed in FIGS. 1 and 2) is at the left and at the right in FIGS. 3 and 4, respectively. FIGS. 3 and 4 show the opening 30 through the cuff 22 into the interior of the sleeve 24, and the circumference of the opening 30 formed by fabric panels 32, 34 that, at the extension 36, lie parallel to and against each other and are substantially or entirely adhesively bonded to each other. As shown in FIGS. 3 and 4, the opened cuff may be said to have an opened oblong diameter OBD1, which is the maximum cuff opening due to no folding over or fastening of any portion of the cuff circumference. Extension portion 32' of panel 32 extends to the right in FIG. 3 and is bent 180 degrees at edge 37 to result in portion 32" extending to the left in FIG. 3 to meet the extension portion 34' of panel 34 at junction 38. Portion 32" is adhesively bonded to portion 32' and extension portion 34' is adhesively bonded to another region of portion 32'. It may be noted that extension portion 32' is parallel but not co-planar to portion 34', and that portion 32", because it is folded back to meet portion 34', may be described as co-planar with portion 34' but not connected to portion 34' by a seam due to both portion 32" and 34' are adhesively connected to underlying portion 32'. Therefore, these parallel portions/extensions of the panels are bonded to form an extension of the circumference, and there is preferably no sewn seam in the extension 36. Further, there is preferably no separate tab/tab-piece connected to the circumference of the cuff, including no tab inserted and sewn at a seam in the cuff. Also, hook fastener 40 and loop fastener 42 are applied at a distance D from each other (FIG. 3), on the extension 36 of the cuff 22 and on panel 34 near the bottom-side 26 of the lower sleeve, respectively. This distance D, for example 1-2 inches, and the resulting Gap G are important for convenient adjustment of the cuff diameter, wherein, as described in more detail below, having the gap G bounded on one end by a relatively rigid fastener strip (42) is also important for convenient adjustment of the cuff diameter, wherein "relatively rigid" herein means more rigid than the fabric of the cuff.

In certain embodiments, extension 36, 136 of the cuff 22, 122 comprises, consists essentially of, or consists of two planar panels, one folded at edge 37, 137, and adhesive or adhesive-sheet between the panels. Each planar panel may be of one or preferably more layers of fabric including moisture-resistant or moisture-proof layers, wherein the layers are bonded by non-sewing techniques, known in the highly technical fabric field, to result in a thin unitary panel. Therefore, one may describe the extension 36, 136 as being formed by panel portions that are co-extensive, lying parallel against each other, and being adhesively connected, wherein the extension portion may be easily grasped during folding of the cuff flap to the desired tightness. Therefore, no separate tab needs to be added to the cuff, and no bulky seam is required to connect two folded and abutting panel edges and to anchor a tab into the seam. Certain embodiments may therefore be described as combining highly technical fabrics, few or no seams in the cuff, and few or no stacked materials, to make the cuff water-resistant or waterproof, to be comfortable, and to have a clean and sleek appearance.

FIGS. 5 and 6, and the enlargements of the distal ends of FIGS. 5 and 6 shown in FIGS. 7-9, show the sleeve 22 tightened to some extent ("loosely tightened") to reduce the diameter of the cuff opening 30 and fastened by connecting the two hook-and-loop fasteners. The "oblong diameter" OBD2 labeled in FIGS. 7 and 8 is the length of the oblong cuff opening 30 in this loosely tightened condition that is reduced relative to cuff opening oblong diameter OBD1 in FIGS. 3 and 4. From this oblong diameter OBD2, the reduced diameter of the generally circular cuff as worn when loosely tightened will be understood. Said tightening is done by pulling the extension 36 slightly away 'from the wearer's arm, and then folding it circumferentially toward fastener 40, wherein, for such moderate tightening, the cuff circumference typically folds over at bend B at or near the end 42E of the fastener strip 42 (the fastener strip 42 also being called herein "first fastener" and end 42E may be called a "boundary along which the cuff tends to fold"). This bend B location naturally from the stiffness/rigidity of the fastener relative to panel 34, which forms a boundary (F1) prone to bending/folding. The bending/folding of portions of the thin circumference panels during tightening may be described, as above, as forming cuff flap 39, and, in effect, a gusset GS hidden underneath the flap 39, the gusset representing, for example, about 2.5 inches of cuff opening circumference that disappears from view, entirely or substantially, when the cuff is tightened to this moderately tightened condition and then fastened by pressing fastener 4 against fastener 40 (fastener 40 also being called herein "second fastener"). Note that no folding of the sleeve's forearm fabric (see 24") occurs due to the folding-over of the cuff flap 39.

FIGS. 10 and 11 illustrate sleeve 22 tightened to a greater extent ("substantially tightened") than in FIGS. 7-9, to further reduce the diameter of the cuff opening to an oblong diameter OBD3, from which will be understood the further-reduced diameter of the generally circular cuff as-worn when substantially tightened. As FIGS. 7-11 are drawn to scale, one may compare the cuff opening oblong diameters OBD2 of FIGS. 7 and 8 with the cuff opening oblong diameter OBD3 of FIGS. 10 and 11, and see that there is a significant increase in tightening and significant reduction in cuff opening diameter. Said increased tightening is done by first pulling the extension 36 slightly away from the wearer's arm as in the method of tightening the cuff as in FIGS. 7-9, but then pulling the extension 36 circumferentially farther in the direction toward fastener 40. For this increased tightening, the bend B' of the cuff circumference, which creates larger cuff flap 39', is desired to be closer to fastener strip 40, rather than at or near the end 42E of the fastener strip 42, resulting in more of fastener 40 being covered by fastener 42 and in a longer gusset GS. The fastener 42 is then pressed against fastener 40 for fastening the cuff in this more-tightened condition. Still, as one may see from FIGS. 10 and 11, the cuff remains low-profile and has a sleek appearance.

Therefore, across a spectrum of relative tightness from loose (unfastened, FIGS. 3 and 4) to moderately tight (FIGS. 7-9) to increasingly tight (FIGS. 10 and 11), or even tighter than shown (with the extension 36 and fastener 42 even farther to the right relative to fastener 40 in FIG. 10, and consequently even larger cuff flap and gusset), the cuff maintains a low-profile, sleek appearance due to thin, parallel cuff circumference panels forming the extension and underlying bended/folded gusset, and due to the lack of seams and lack of bunched-up and stacked fabric. Note that the thinness of the cuff circumference panels is further enhanced by the bottom hem of the cuff preferably being folded over and glued, rather than stitched as in a conventional hem, thus removing as much extra seam bulk as possible. Further, the cuff and sleeve structure is adapted to have a 'waist' at the wearer's wrist that greatly reduces or eliminates the extra bulk caused by folded sleeve material above the cuff and up along the sleeve length.

It should be noted that the hook fastener strip 42, or other fastener provided on the extension, preferably has sufficient rigidity that the fastener strip at its inner edge (such as 42E) creates a relatively hard point/line at which the extension naturally tends to bend/fold. This natural point/line of bending makes tightening to a moderate amount a very easy operation of the cuff for a tightness that suits many situations. As described above, increased tightness may be achieved by modifying the amount the extension is pulled relative to the cooperating fastener strip 40 and/or by using finger(s) to hold the strip 40 and its region of the circumference generally in place while the strip is pulled farther relative to the strip 40 for tighter adjustment.

FIG. 12 is a perspective rear view of the distal end of an alternative embodiment of cuff 22', partially tightened and fastened ("loosely fastened"), wherein the extension 36' of the cuff comprises two parallel layers 37A and 37B of fabric extending parallel all the way to the edge of the extension 36' and being adhesively connected AD, with neither of the two parallel layers folding over at the edge. In certain alternative embodiments of the cuff for a garment, alternative fasteners may be used, for example, alternative hook and loop strip configurations and arrangements, buttons and buttonholes, snaps, quiet snaps, and/or other fasteners. In certain embodiments, snaps may fasten the cuff generally or substantially as described above in this document but using alternative fastening means.

General Description of Certain Embodiments Comprising Water-Directing Brim Improvement:

In certain embodiments, the invention comprises a specially adapted hood with brim provided on a piece of clothing (or "garment") that is worn on a user's head, for example, the hood of a weather/storm-protection jacket.

In certain embodiments of the hood, the brim is horizontally elongated and is attached/connected to the hood, preferably by extending integrally from the hood, at generally the forehead level, but above the boundary/edge of the hood that defines the face opening. The brim is curved convexly (in top view) and has an outer edge (also, the "front edge" when the brim is flipped down, and the "top edge" when the brim is flipped up) that is curved to be non-circular. In preferred embodiments, the brim comprises right and left ends that are lower than the center CT of the brim connection CB, and that protrude to the right and left beyond the hood opening. Thus, these right and left ends form "right and left eaves" or "right and left eave ends" that, in the lowered brim position, protrude outward from the hood to assist in directing and/or shedding water at a distance from the opening and the user's face. These right and left eave ends, in the raised brim position, still protrude right and left beyond the right and left extremities of the opening edge, and they are still lower than the center CT of the brim connection CB, so that they still assist in directing/shedding water to the right and left of the face opening. The brim may be flipped/pivoted between raised and lowered positions and is effective in both positions for directing water from the user's face, while tending not to block the user's vision. The brim is stiffened between its outer edge and its inner edge (when the brim is flipped up, the "bottom edge"), and effectively flips/pivots, when urged by a user's hand, around a flexible cloth "axis" or "axle" located between the stiffener and the hood portions that is formed of the hood's fabric panels extending above and below the brim.

In view of FIGS. 13-20, and the description below, it will be understood that certain embodiments may be described as featuring a brim on a hood that is not part of the face opening, specifically not being an extension of, and not being attached to, the edge of the fabric that forms the face opening. This structure works better than prior art brims, as the disclosed brim essentially creates an eave that directs water away from the hood opening around the face. Conventional flip up hood brims are either a part of the hood opening edge or are sewn into the seam at the top edge of the hood opening, so that these prior art brims are not distanced from the opening or the edge that defines the opening and do not extend past the opening to the right and left. Neither of these prior art constructions create an eave that redirects water away from the opening edge. Further, unlike conventional brims, the disclosed brim, when flipped up, creates a "gutter" that continues to redirect water away from the opening around the face to the right and left "open ends of the "gutter" that are to the right and left of the opening.

Secondary benefits of the preferred brim embodiments are that, while brim is down, the brim provides extra shade from sun, keeps dry a glass being used by the wearer (spotting scope, binos, range finder, scope, etc). Further, the preferred brim may be formed/connected to the hood without a seam or stitching at its junction/connection to the hood, preventing water from flowing through such a seam/stitching and into the hood.

Referring Specifically to FIGS. 13-20:

FIG. 13 is a front-left perspective view of the hood 200 with brim 210 that is shown as part of the jacket 10 of FIG. 1, but with the brim 210 is in its raised position. FIG. 14 is a front view, and FIGS. 15 and 16 are left and right views, of the hood 200 with raised brim 210. FIG. 17 illustrates schematically how the raised brim affects water flow to direct the water away from the opening and therefore, from the user's face. It will be noted from FIGS. 14-16 that the brim 210 right and left halves, and therefore the right and left eave ends, are preferably mirror images of each other, so the water will flow behind the raised brim, between the brim and the crown 220 of the hood, and will flow out from the right side of the brim, flowing down off the right eave end, in the same or similar way as the water is shown flowing out from the left side/eave end of the brim in FIG. 17.

The hood 200 comprises a generally cylindrical hood body with a neck region 215 connected to and extending integrally up from the jacket, a forehead region 248 (FIG. 18), a crown 220, and a zipper 225 that is the upper end of the jacket zipper. In the front of the hood body is a generally circular, or more preferably horizontally-oblong, face opening 230 defined by an opening edge comprising lower edge 232, left and right edges 234, 236, and an upper edge 238. The opening in certain embodiments may be described as generally semi-circular, wherein the lower edge 232 may be described as circular or generally circular, and the upper edge may be described as horizontal and linear or generally linear. The brim 210 inner edge 240 (aka the "bottom edge of the raised brim" in FIGS. 13-17) is located at a distance R from the opening upper edge 238 and the brim extends integrally from the hood body at that inner edge 240. The inner edge 240 may also be said to extend integrally from, or be connected to, the hood at an elongated connection CB. The preferred integral connection is formed by upper and lower fabric panels of the hood extending integrally to the brim and across the brim from the inner edge 240 to the outer edge 246. Therefore, the axis/axle on which the hood flips/pivots may be described as an axis/axle formed by two close and flexible fabric panels along a curved line inward (toward inner edge 240) from the brim's internal stiffener that are provided between said panels. Edge 240 and therefore the brim-to-hood connection CB extend generally horizontally, but preferably in a curve, from a brim left corner 242 that is left of the opening left edge 234, across the front of the hood 200, and to a brim right corner 244 that is right of the opening right edge 236.

Inner edge 240 of the brim is located a distance R from the opening upper edge 238, preferably all along the width (left to right) of inner edge 240 and connection CB. Thus, the brim is distanced from the opening to be above the opening, that is, each brim point on curved inner edge 240, and consequently on curved connection CB, is above the corresponding point of the opening upper edge 238 located vertically directly-below, as best seen in FIGS. 13 and 14. While the upper edge 238 of the portrayed embodiment of opening 230 is curved to be higher in the middle than on the ends, the edge 240 of the brim is also curved in the same/similar manner (see FIG. 14). Therefore, in certain embodiments, distance R is the same or substantially the same all along the width of the opening 230 and the width of edge 240. In other embodiments, distance R may vary along edge 240, but preferably is not zero at any location along edge 240. Distance R is preferably in the range of 0.75 to 3 inches, and more preferably 1-1.5 inches. This way, the brim inner edge 240, whether the brim is raised or lowered, is a significant distance from/above the opening 230. In preferred embodiments, this has multiple benefits, for example, the wearer's view tends to be un-hindered by the brim and both the raised and the lowered brim shield the opening 230 and the user's face from water, as further described below.

At its left end, the brim outer edge 246 bends/curves from its generally horizontal orientation to extend down toward the left corner 242, forming left eave 252. At its right end, the outer edge 246 bends/curves from its generally horizontal orientation to extend down toward the right corner 244, forming a right eave 254 (FIG. 16). These eave ends 252, 254 help block water from falling into the right and left sides of the opening when the brim is lowered, as will be further described later in this document.

While FIGS. 15 and 16 show the raised brim to be against or very close to the hood surface behind the brim, the brim is not pressed or urged against the hood surface to an extent that liquid-seals the brim to the hood surface. FIG. 17 schematically illustrates, by emphasizing a space SP between the brim and hood surface, that water W running down the crown and forehead region of the hood toward that space SP flows behind the brim, that is, between the brim and the hood surface, and the space SP serves as a "water gutter". This space SP may be significant, for example, because the brim is relatively rigid compared to the flexible fabric of the crown 220 and the forehead 248, and so the crown and forehead tend to bend or collapse slightly away from the relatively rigid brim due room inside the hood between the user's head and the crown and/or due to cinching of tightening/fitting mechanisms that may be provided on the hood to pull the hood fabric for closer fitting to the head. Upon flowing to the space SP between the brim and the forehead region, the water tends to flow down along/behind the rear side of the brim toward/to the location where the brim meets the hood (brim-to-hood connection CB) and, then, because the connection CB is convexly curved (in top view), to the right and left, the water W flows right and left due to the and out from between the brim and hood at the left and right corners 242, 244. The left and right corners 242, 244 are respectively horizontally left and right out past the left and right extremities 262, 264 of the opening 230, and are lower than the center CT of the connection CB. Therefore, water W flowing toward, and falling out from, the left and right corners 242, 244 misses the opening and the user's face and tending to fall to other exterior regions of the hood or the jacket body. See the relative positions of corners 242 and 244 and extremities 262, 264 in FIGS. 13-17, and see the schematic water flow arrows W in FIG. 17.

FIGS. 18-20 illustrate the hood 200 wherein the brim 210 has been flipped down to its lowered position, again at the axis/axle generally corresponding to the inner edge 240 and connection CB. These drawings illustrate the preferably slanted/sloped forehead region 248, the convex shape (in top view) of the brim connection CB, and the brim left and right corners 242, 244 and eave ends 252, 254. Further, these drawings illustrate that the brim in the lowered position slants downward from the inner edge 240 at the hood to the outer edge 246. Therefore, as schematically shown in FIG. 20, when the brim is in the lowered position, water W flows forward and off the brim and also left and right off the eave ends 252, 254, avoiding the opening 230 and the user's face. Preferably, the eave ends 252, 254 extend at least 0.25 inches, preferably in the range of 0.5-2 inch or more preferably 1-1.5 inches, horizontally out past the extremities of the opening 262, 264. Given that the left and right extremities 262, 264 are near the top of the preferred opening 230 and that the preferred opening 230 is progressively narrower towards its bottom, these fairly small "left and right overhangs" of the eave ends 242, 244 are sufficient in many embodiments to effectively shield the opening and the user's face from water entering at the left and right sides of the opening.

Therefore, certain embodiments may be described as a movable/flippable brim constructed into a hood separate from the face opening, to create an 'eave' or "overhang" above, forward, and to the right and left of the face opening of the hood itself. This construction creates an articulating brim to increase versatility, and rain protection. Strategically placed stiffener(s) are engineered into the brim and hood to provide structure necessary for articulation of the brim to both upward- and downward-facing positions. With the brim down, sun and rain protection are maximized, and the front face opening is minimized. With the brim articulated up, the wearer's field of view is maximized, and the brim acts as rain gutter to channel water away from the face opening to the sides of the hood to minimize moisture intrusion. Without this gutter and the associated channeling away from the face opening, the possibility of water entering through the face opening and into the garment would be increased, wetting the user and typically the user's clothing worn underneath the jacket.

In contrast, traditional hoods may be used over headwear that has a single brim that is fixed into one position, and, depending on head size and the type of headwear used in cooperation with the traditional hood, the user's field of view may be inhibited, or the hood may conflict with the headwear used underneath, creating discomfort and diminishing functionality/usability of hood. Also, a traditional hood over a conventional brimmed cap will not shield the hood opening or the user's face from water to a satisfactory extent and especially will not direct water satisfactorily away to the left and right beyond the hoop opening.

The brim fabric is preferably made to be integral with the hood's fabric panels that extend above and below the brim. This way, the fabric of the top of the brim extends continuously from and above the brim, and the fabric of the bottom of the brim extends continuously from and below the brim, resulting in no seam being used to attach the brim to the hood. A stiffener is placed between the fabric panels portions on the top and of the bottom of the brim, so that the brim keeps its shape, with the stiffener being positioned so that the brim can flip/pivot at the fabric boundary slightly beyond the stiffener's inner edge at the brim's inner edge 240 (also "CB", or "fabric axis/axle"). The preferred brim is thereby somewhat rigid and will flip up and down without significant deformation and the fabric axis/axle around which the brim flips/pivots is consistent and predictable. Also because of this stiffened brim structure, the brim retains the preferred shape as described and drawn herein and stays effective even during inclement weather. Further, adhesive is used to position and secure the stiffener inside the brim, and there is no seam or stitching present at the edge 240, so that water is prevented from soaking into or through the gutter created at connection CB of the brim to the hood when the brim is either the flipped up or down position.

It may be noted in the drawings that an elongated bump or shoulder is seen at connection CB when the brim is in each of the raised and lowered positions. This is preferably not due to any seam or stitching, and not due to any joining of multiple panels of fabrics at connection CB, because, as explained above, there is no seam or stitching at connection CB and, instead, the fabric panels on the top and the bottom of the brim each continuously extend from the brim to the hood across connection CB. Instead, the stiffener provided inside the brim gives the brim extra thickness, which results in the bump/shoulder.

Although this disclosed invention has been described above with reference to particular means, materials and embodiments, it is to be understood that the disclosed invention is not limited to these disclosed particulars, but extends instead to all equivalents within the broad scope of the following claims.

The invention claimed is:

1. A garment comprising a hood for being worn on a user's head, the hood comprising:

a hood body having a front side comprising a face opening defined by an opening edge, wherein the opening edge comprises an upper edge, a lower edge, and left and right edges having right and left extremities;

a brim connected to the hood above and distanced from the opening upper edge, the brim being flippable to a lowered position extending forward and to a raised position extending upward;

the brim having right and left eave ends that extend horizontally to the right and left beyond said right and left extremities, so that when the brim is in the lowered position, water flows off a front edge of the brim and off the right and left eave ends so that the water does not reach the face opening.

2. The garment as in claim 1, wherein the brim is connected to the hood at a connection that has a center and has right and left end corners, wherein the right and left end corners are lower than the center in both the lowered and the raised positions.

3. The garment as in claim 2, wherein, in the raised position, the brim extends up along a forehead portion of the hood with a space between the brim and the forehead portion, so that water flows down into the space and right and left to exit the space at the right and left end corners of the connection to flow down from the hood to the right and left of said right and left extremities.

4. The garment as in claim 3, wherein the connection comprises no seam.

5. The garment as in claim 3, wherein the connection has a length between said right and left end corners, and the connection is spaced from the upper edge all along the length a distance in the range of 0.75 to 3 inches.

6. The garment as in claim 1, further comprising:

a sleeve with a forearm and a cuff attached to the sleeve forearm by a waist connection, wherein the forearm at the waist connection has a waist diameter;

the cuff having a cuff opening and being adapted to be in an untightened configuration having an untightened cuff opening diameter that is larger than the waist diameter, and the cuff adapted to be fastened in a tightened configuration having a tightened cuff opening diameter that is smaller than the untightened cuff opening diameter.

7. The garment as in claim 6, wherein the sleeve forearm is tapered in diameter from an upper region diameter of the sleeve forearm to the waist diameter, wherein the waist diameter is smaller than the upper region diameter.

8. The garment of claim 7, wherein the cuff comprises a first fastener on an outer surface of the cuff and a second fastener on an outer surface of the cuff, so that the cuff is adapted to be folded over on itself and held in the tightened configuration by connection of the first fastener to the second fastener.

9. The garment of claim 8, wherein, when the cuff is in the tightened configuration, the cuff is folded over on itself and the forearm of the sleeve is not folded.

10. The garment of claim 8, wherein, wherein, when the cuff is in the tightened configuration, the cuff is folded over on itself, the sleeve forearm is folded over on itself along a length of the forearm in the range of 1-4 inches, and the sleeve above the forearm is not folded.

11. The garment of claim 8, wherein the first fastener is a hook and loop fastener that is more rigid than the cuff, the first fastener having an inner edge forming a boundary along which the cuff folds over on itself for tightening.

12. The garment as in claim 11, wherein the inner edge is positioned at a location on the outer surface of the cuff that places the boundary in alignment with the waist diameter so that folding of the cuff at the boundary reduces the cuff diameter to be the same as the waist diameter and does not fold the forearm of the sleeve or reduce the waist diameter.

13. The garment as in claim 11, wherein the cuff further comprises an extension to which an outer edge of the first fastener is connected.

14. The garment as in claim 13, wherein the extension is formed by adhesive connection of panels of the cuff and does not comprise any sewn seams.

15. The garment as in claim 13, wherein the first fastener and the second fastener are 1-2 inches apart.

* * * * *